United States Patent [19]

Armfield et al.

[11] 4,422,781

[45] Dec. 27, 1983

[54] PRINTING APPARATUS AND METHOD WITH VARIABLE VELOCITY ON-THE-FLY PRINTING

[75] Inventors: Stephen C. Armfield, Londonderry; Christopher W. Brock, Bow, both of N.H.

[73] Assignee: Centronics Data Computer Corp., Hudson, N.H.

[21] Appl. No.: 353,649

[22] Filed: Mar. 1, 1982

[51] Int. Cl.[3] ..... B41J 3/04

[52] U.S. Cl. ..... 400/18; 400/70; 400/126; 400/322; 318/561

[58] Field of Search ..... 364/174; 318/561, 594; 400/70, 126, 19, 320, 144.2, 322.18, 280, 154.2

[56] References Cited

U.S. PATENT DOCUMENTS

| | | | |
|---|---|---|---|
| 3,887,796 | 6/1975 | Trousdale et al. | 364/174 |
| 3,893,616 | 7/1975 | Trousdale | 364/174 |
| 3,908,195 | 9/1975 | Leenhonts | 364/174 |
| 3,950,685 | 4/1976 | Kraner | 400/280 |
| 4,150,902 | 4/1979 | Brescia | 400/17 |
| 4,178,108 | 12/1979 | Kane | 400/144.2 |
| 4,189,246 | 2/1980 | Kane et al. | 400/144.2 |
| 4,268,783 | 5/1981 | Murray | 318/561 |
| 4,293,233 | 10/1981 | Hoffman | 400/144.2 |
| 4,324,499 | 4/1982 | Giacone | 400/144.2 |
| 4,355,273 | 10/1982 | DuVall | 318/561 |

*Primary Examiner*—William Pieprz

*Attorney, Agent, or Firm*—Kenway & Jenney

[57] ABSTRACT

A method and apparatus for controlling the velocity of a carriage in a calligraphic type printing apparatus maximizes average velocity across the printing line. The method and apparatus, based upon the present carriage velocity and the maximum future carriage velocities along a predetermined next portion of the printing line, determine the direction of velocity change for the carriage, if any change is needed. Accordingly, the velocity of the carriage is controlled so as to not exceed maximum carriage velocities at various points along the printing line. These maximum carriage velocities are determined by the symbols being printed and in particular by the complexity of the symbols being printed. The method and apparatus can operate either on a demand or on a line-by-line basis.

15 Claims, 8 Drawing Figures

CHARACTER LOOK - AHEAD POSITION

125b

| (MAXIMUM VELOCITY AT LOOK-AHEAD INCREMENT) LESS (PRESENT VELOCITY) IN ½"/SEC. UNITS | 1 | 2 | 3 | 4 | 5 | 6 | 7 | 8 | 9 | 10 | 11 | 12 |
|---|---|---|---|---|---|---|---|---|---|---|---|---|
| 0 | 0 | +1 | +1 | +1 | +1 | +1 | +1 | +1 | +1 | +1 | +1 | +1 |
| -1 | -1 | 0 | +1 | +1 | +1 | +1 | +1 | +1 | +1 | +1 | +1 | +1 |
| -2 | -1 | -1 | 0 | +1 | +1 | +1 | +1 | +1 | +1 | +1 | +1 | +1 |
| -3 | -1 | -1 | -1 | 0 | +1 | +1 | +1 | +1 | +1 | +1 | +1 | +1 |
| -4 | -1 | -1 | -1 | -1 | 0 | +1 | +1 | +1 | +1 | +1 | +1 | +1 |
| -5 | -1 | -1 | -1 | -1 | -1 | 0 | +1 | +1 | +1 | +1 | +1 | +1 |
| -6 | -1 | -1 | -1 | -1 | -1 | -1 | 0 | +1 | +1 | +1 | +1 | +1 |
| -7 | -1 | -1 | -1 | -1 | -1 | -1 | -1 | 0 | +1 | +1 | +1 | +1 |
| -8 | -1 | -1 | -1 | -1 | -1 | -1 | -1 | -1 | 0 | +1 | +1 | +1 |
| -9 | -1 | -1 | -1 | -1 | -1 | -1 | -1 | -1 | -1 | 0 | +1 | +1 |
| -10 | -1 | -1 | -1 | -1 | -1 | -1 | -1 | -1 | -1 | -1 | 0 | +1 |
| -11 | -1 | -1 | -1 | -1 | -1 | -1 | -1 | -1 | -1 | -1 | -1 | 0 |
| -12 | -1 | -1 | -1 | -1 | -1 | -1 | -1 | -1 | -1 | -1 | -1 | -1 |

125c

124

125a

PRINTING APPARATUS AND METHOD VARIABLE VELOCITY ON-THE FLY PRINTING

BACKGROUND OF THE INVENTION

This invention relates generally to printing apparatus and methods and more particularly to a printing apparatus and method for controlling the printing carriage velocity in an on-the-fly calligraphic printing system.

Mechanical printers have long been available and have increased their printing throughput in order to match the exploding output requirements of today's electronic apparatus. With the advent of both microprocessor controlled devices and the "small computer", the need for fast, reliable, and yet relatively inexpensive printers has resulted in the development and refinement of a number of printing techniques. Among those techniques is the calligraphic printing approach.

In a typical calligraphic printing system, a pen or stylus, together with its drive mechanism, is supported on a moving carriage. The carriage is moved from one writing position to a next writing position. At each writing position the pen or stylus traverses the path of the desired symbol to be written. During the writing time, the carriage is generally at rest.

In order to reduce the time required for printing, apparatus described in copending applications U.S. Ser. Nos. 242,660 and 242,663 employ an "on-the-fly" printing technique wherein the carriage is always moving and the drive mechanism for moving the pen or stylus, carried by the carriage, is dynamically compensated according to the changing position of the carriage. The carriage is generally in motion and carriage acceleration/deceleration time requirements, present when the carriage is stopped at each symbol, are no longer present.

In the particular printer apparatus described in copending U.S. application Ser. Nos. 242,660 and 242,663, the printing carriage which supports the stylus moves along a printing path at a selected velocity while writing is effected on-the-fly. The writing stylus is selectively actuated and positionally controlled to mark a recording medium with intelligible indicia. However, the writing of the various symbols will not, in general, require the same time duration for their completion. This is true even though the spatial extent of or allowed for each character, in the direction of movement of the printing carriage, may be a constant value. Thus, when the carriage velocity is fixed at a constant value, the value is substantially determined by the indicia or symbol which requires the most time to print.

It is therefore an object of this invention to provide, in a calligraphic printing apparatus wherein individual symbols generally require different times for printing, a method and apparatus for increasing average velocity along the printing path without loss in printing quality.

Other objects of the invention are a printing apparatus and method which provide a minimum carriage traverse time for each printing line, the time being generally different from line to line, which are reliable, simple in construction and operation, and which provide increased throughput of operation.

SUMMARY OF THE INVENTION

The invention relates to a calligraphic printing apparatus having a moving carriage carrying a printing mechanism, an assembly for moving the carriage along a printing path for reproducing a plurality of symbols, and a carriage control element. The carriage is moved along the printing path in response to the carriage control element for reproducing the plurality of symbols. The printing path is divisible into a plurality of distance-velocity increments. (The distance-velocity increment is the spatial extent required to change the carriage velocity by a known incremental amount.) The invention features the improvement wherein the carriage control element has an element for determining, for each distance-velocity increment along said printing path, a maximum carriage velocity, and a second element responsive to the maximum carriage velocities for determining, for each distance-velocity increment along the printing path, an optimum change in carriage velocity. Thereby, the carriage can traverse the printing path at a variable carriage velocity while the symbols are being written.

In another aspect of the invention, the carriage control element features a first memory for storing printing path time/velocity data for each printing symbol, a second memory for storing at least a selected minimum number of next symbols to be printed in the path, an element responsive to the first and second memory contents for associating with each increment a corresponding maximum carriage velocity, and a velocity control device for controlling changes in the velocity of the carriage at each increment along the printing path depending upon the maximum carriage velocity associated with each of a minimum number of next increments.

The invention, in another aspect, relates to the method for controlling carriage velocity. The method employs the steps of determining, for each increment, and in response to the symbols at least in part written in said increment, a maximum carriage velocity, and determining, for each increment along the printing path, an optimum velocity change for the carriage from the said increment to a next increment, whereby the carriage velocity is always no greater than the maximum allowed velocity in each increment along the printing path.

According to the invention, the symbols can be processed either as they are being entered into the apparatus and while the carriage is moving, that is, while the carriage is "on-the-fly", (a "demand" condition), or a whole printing line of symbols can be stored and processed as a group so that while one line is being entered into and processed in the apparatus, the previous line is being printed according to data already generated. In either case, it is advantageous to employ a look-ahead table which provides changes in carriage velocity depending upon the present carriage velocity, a maximum future carriage velocity, and the distance between the increments corresponding to the present and future velocities.

DESCRIPTION OF THE DRAWINGS

Other objects, features, and advantages of the invention will appear from the following description of a preferred embodiment taken together with the drawings in which.

DESCRIPTION OF THE PREFERRED EMBODIMENT

Figure 1:
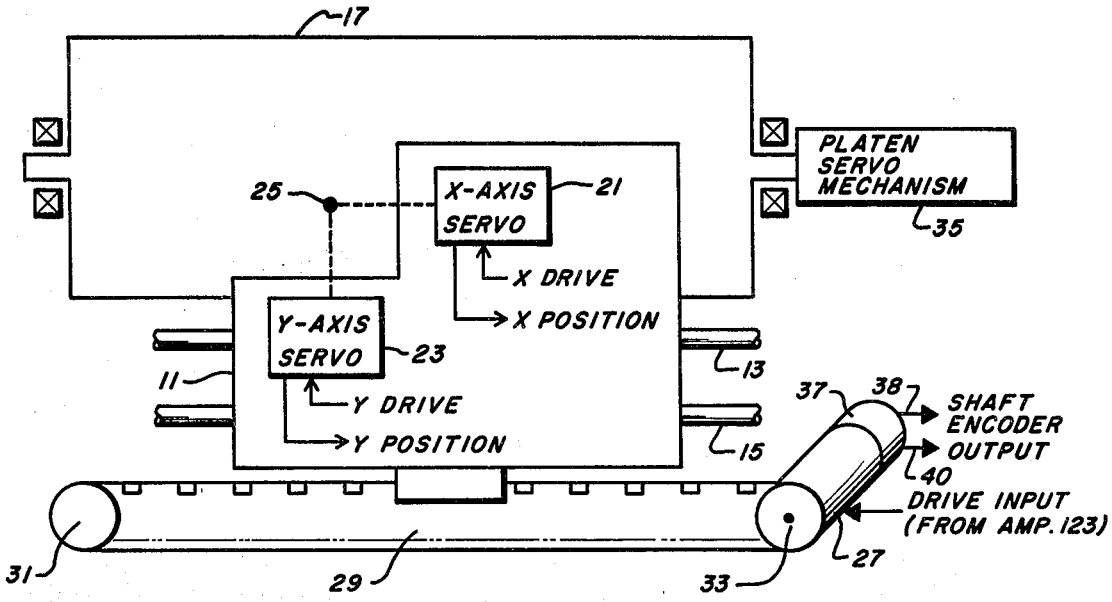
FIG. 1 is an overall schematic diagram of a calligraphic writing mechanism with which the present invention can be employed.

Referring to FIG. 1, a carriage mechanism 11 is slideably mounted on a pair of rails 13 and 15 so as to be moveable in a controlled, spaced apart relationship, along a platen 17. Platen 17 is preferably, for example, a typewriter roller, however other moveable or fixed platen structures can be employed.

Carriage 11 carries a pair of linear transducers or servomotors 21 and 23 which are adapted for moving or positioning a pen or stylus 25. The servomotors 21, 23 are preferably oriented for moving the stylus 25 along essentially transverse axes. Thus, servomotor 21 moves the stylus along an axis parallel to the carriage motion (the X-axis) while servomotor 23 moves the stylus along the transverse or vertical axis (the Y-axis). Each linear transducer 21 and 23 is responsive to a control signal, generated as described in more detail below, for moving the stylus along the respective axis and further includes also a feedback component for generating a feedback or position signal. In this manner, the stylus servomechanisms can operate in a closed loop feedback configuration. In the illustrated embodiment, optical feedback transducers are employed. Carriage 11 typically includes a third drive mechanism (not shown) for applying a load to the stylus to effect writing.

As the carriage is moved along the platen 17, X-Y stylus movement in each character position or domain is effected by energizing the linear servomechanisms 21 and 23 to move the stylus 25 in accordance with a set of vectors defining the character. Associated with each vector is a command to load or unload the stylus. The definition of these vectors is preferably stored in digital form in a suitable digital memory, e.g. a read only memory, which may be readily interchanged to effect changing from one font to another. The stylus 25 may be in the form of a pen to effect direct writing or, preferably, will press through a carbon film ribbon to effect writing on paper supported by platen 17.

Carriage 11 is moved along the length of platen 17, the printing path, by a d.c. servometer 27 which drives a belt 29 passing over rollers 31 and 33. Movement of the paper in the transverse direction, i.e. vertical, is effected by a stepping motor 35 which rotates roller platen 17.

The servomotor 27 is provided with a shaft encoder 37 to provide a feedback mechanism for sensing movement of the carriage and for keeping track of its position. Illustrated encoder 37 provides square wave signals in phase quadrature, as indicated at 38 and 40, so that both motor speed and direction of rotation can be determined. These positional information signals are provided to the overall control processor of FIG. 2 as control signals as well as to the servo control circuitry of FIG. 3.

Figure 2:
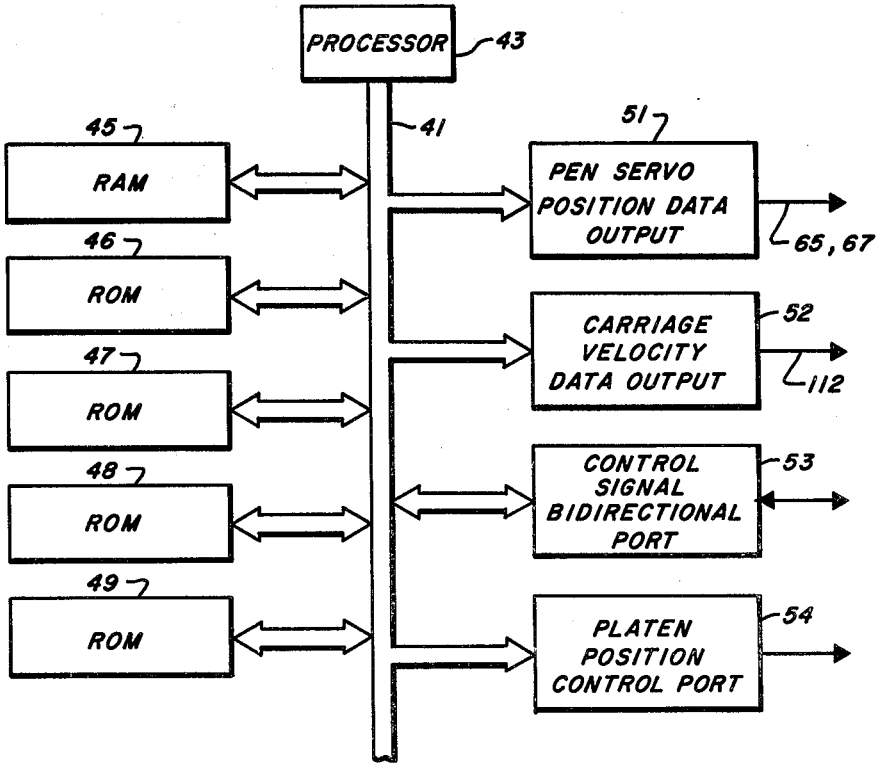
FIG. 2 is an overall block diagram of a generalized microcomputer system appropriate for providing data to the circuitry of FIG. 3 and for generally supervising operation of the apparatus.

As indicated previously, the data representing the vectors which make up each symbol are preferably stored in digital form in a read only memory and are utilized by a microprocessor controller to generate the actual data which controls the stylusdriving servomechanisms and the carriage drive. Referring to FIG. 2, the illustrated microprocessor system is bus-oriented, that is, memory devices, input/output (I/O) ports, and a processor 43 are all connected to a common data and control bus 41. In the illustrated embodiment of the invention, processor 43 is an Intel 8085A-2 microprocessor and the memory and I/O components are implemented using integrated circuits from the same family of devices or compatable TTL devices. As is understood, the advantage of using a microprocessor-driven controller is that the mode of operation may be flexibly changed under software control, without extensive hardware redesign. In implementing its control function, the processor utilizes a random access memory (RAM) 45 for storing operating parameters. Fixed data, e.g. data defining the vectors which make up each character in a font, are stored in illustrated read only memories 46, 47, 48, 49.

Figure 3:
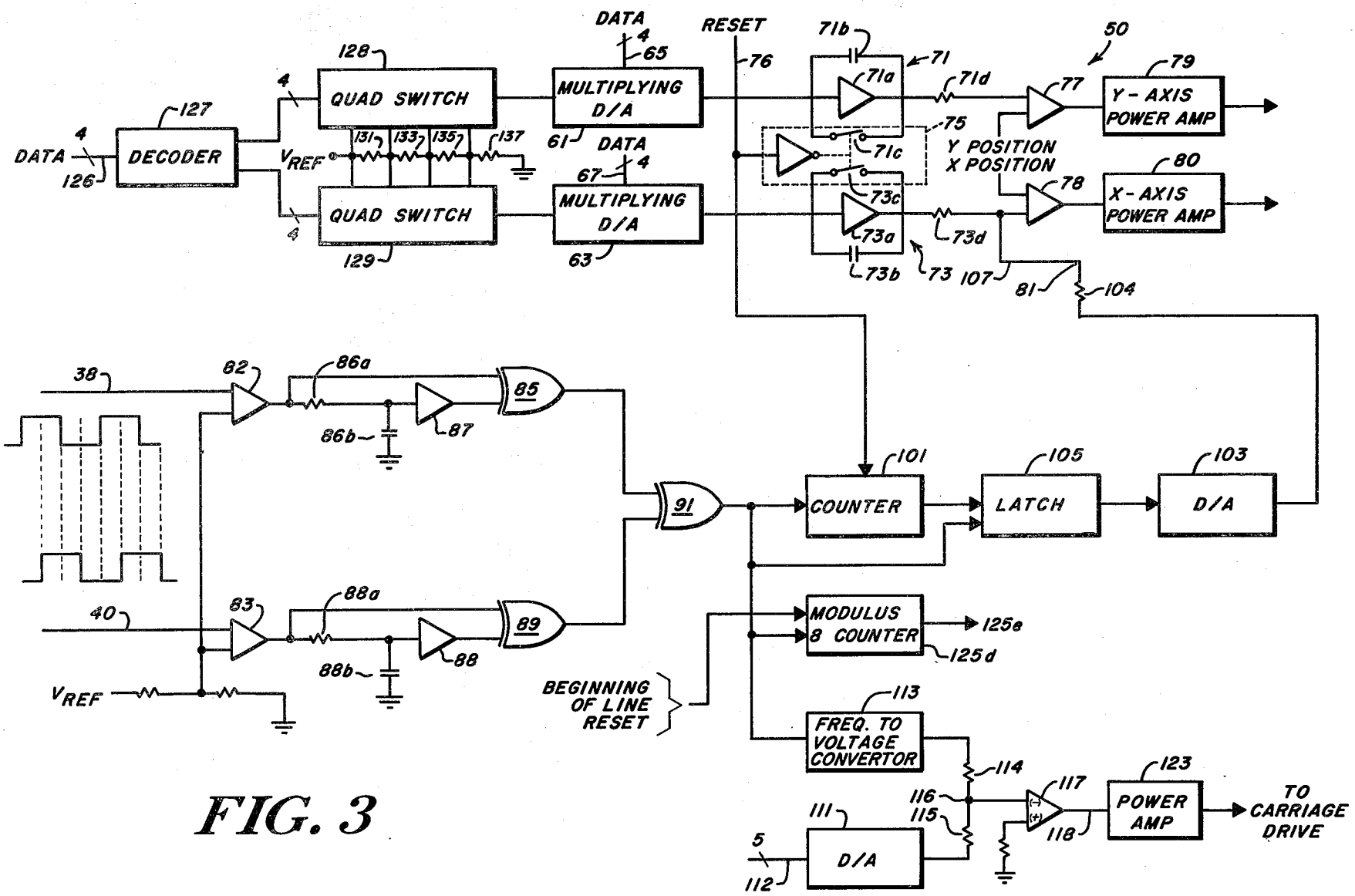
FIG. 3 is a schematic diagram of control circuitry employed in operating the mechanism of FIG. 1 in accordance with the preferred embodiment of the present invention.

The microprocessor system provides digital data for defining the operation of the control circuitry 50 of FIG. 3 through latched output ports 51 and 52. Port 51 provides data for the pen servo mechanisms while the port 52 provides carriage velocity control information. As is common to microprocessor control systems, various control signals are needed by the processor 43 to determine the physical state of the mechanism apparatus and various control signals are provided from the processor to the mechanism controllers. A bi-directional port 53 fills this function. A fourth I/O port 54 is provided for vertical control, that is, for controlling the stepping motor 35. However, the vertical control system forms no part of the present invention and is not disclosed in detail herein.

Preferably, the vector defining data for each symbol is stored in terms of a sequence of vectors, i.e., directions and lengths, (including stylus control information), standard symbol width, and a maximum carriage velocity at which a standard size symbol can be written. (The maximum carriage velocity need not be stored but can be derived from the information defining the vector sequence. It is included to reduce processor overhead.) Among the functions performed by the microprocessor system of FIG. 2 is to expand the "raw" data and generate for the conditions of size specified by the operating input system, respective X- and Y-axis components for each symbols and the optimum velocity profile along the printing line.

Considering first the X- and Y-axis components, in the illustrated embodiment the component values are each specified to four bits of accuracy and are applied, respectively, to digital to analog converters (DACs) 61 and 63 over lines 65 and 67 of FIG. 3. The values provided to the control circuitry represent velocity components. To obtain spatial displacement values, the voltages obtained from the DACs 61 and 63 are integrated using the circuits indicated at 71 and 73, respectively. Each of these circuits has an inverting amplifier 71*a* and 73*a* and an integrating capacitor, 71*b* and 73*b*, respectively. The capacitors 71*b* and 73*b* can be discharged, to reset the integrators, by respective analog switches 71*c* and 73*c*. This reset condition defines the initial condition for the integrators. A dual analog switch 75 performs this function, together with its control circuitry. The resetting switch circuitry 75 is operated by a control signal, designated RESET, over a line 76, which is one of the signals obtained from the control port 53 of the microprocessor controller of FIG. 2.

The output signals from the integrators 71 and 73 are applied, through respective summing resistors 71*d* and 73*d*, to error amplifiers 77 and 78. The error amplifiers 77 and 78 are responsive to the difference between the integrator output signals and the respective feedback position signals obtained from signals from the X and Y linear servomechanisms 21 and 23. The error amplifiers, in turn, drive, in conventional fashion, X- and Y-axis power amplifiers 79 and 80.

In this preferred embodiment of the invention, each vector is "drawn" in one of four distinct time durations. Each time duration corresponds to a different length vector. (Symbols requiring more vectors and/or longer vectors thus generally take a longer time.) Thus, by varying the data over lines 65 and/or 67, different length lines can be obtained in the same time. Consequently, the data changes periodically at a fixed repetition rate and integrators 71 and 73 provide what is substantially a linear stepwise ramp response to the converter inputs. It is generally at the end of the vector string representing a symbol that the integrators are reset for the next symbol cycle.

Thus far, in the description of the control circuitry of FIG. 3, it has been assumed that the carriage is stationary while the symbol is being drawn. This is not the case however, according to the preferred embodiment of the invention, wherein not only does the carriage move but it may move at varying speeds. The adjusting or compensating signal is provided over a line 81 to the X position amplifier 78. The signal is thus added to the X signal or horizontal direction signal which is obtained from the microprocessor data input over line 67.

As noted above, the position of the carriage can be determined by the quadrature output signals 38 and 40 from the shaft encoder 37 attached to servo mechanism 27. The quadrature output signals 38 and 40 obtained from the shaft encoder 37 are each applied to one input of a respective comparator 82 and 83. A suitable intermediate reference voltage is applied to the other input of each comparator. The output from comparator 82 is applied directly as one input to an exlcusive OR gate 85 and, in delayed form, to the other input of gate 85. The delay is effected by a resistor 86*a* and capacitor 86*b*, with "squaring" of the output signal being performed by a buffer gate 87. The function of this delay and gating circuitry is to provide, at the output of gate 85, a brief pulse for each transition, positive or negative, in the input signal 38. An identical circuit configuration (resistor 88*a*, capacitor 88*b*, and gates 88, 89) provides, in response to the input signal 40, a corresponding pulse train at the output of exclusive OR gate 89. The pulse trains obtained from gates 85 and 89 are combined in an exclusive OR gate 91. The output of this gate provides a pulse for each transition in either of the input signals (38 or 40). In addition, there has been achieved a factor of four multiplication in the pulse rate (compared with the pulse rate of either one of the shaft encoder signals). If the carriage were driven by a stepper motor instead of the d.c. servomotor 27, the pulse signal used to advance that motor might be used in place of the pulse train generated by the shaft encoder 37.

The pulse train obtained from the gate 91 is applied to a counter 101 so that the counter generates a digital value which varies in proportion to displacement of the carriage. This counter 101 is reset by the signal on line 76 when the integrators 71 and 73 are reset at the start of each symbol. Thus, the digital value held by the counter in one sense represents spatial displacement of the carriage across the character domain. The digital value in counter 101 is converted to an analog signal voltage by a digital to analog converter 103, the transfer being buffered by a latch 105 which is loaded in synchronism with the counting to minimize ripple-through effects. The output voltage from the converter 103 for each symbol is a monotonically increasing function for each symbol or character domain, that is, it increases in value as the carriage moves across the character domain. This voltage, however, is not a time dependent function in the usual sense, but rather is proportional to actual displacement of the carriage and thus, in the time domain, will vary as the speed of the carriage varies.

The voltage obtained from converter 103 is mixed in or summed with the X-axis position signal obtained from the integrator 73, the converter signal being applied through a resitor 104 to a summing junction 107 at the high impedance input of error amplifier 78. The addition of this carriage displacement component to the vector-defining voltage allows the writing of characters from a moving carriage without requiring alteration of the basic vector definitional encoding scheme. Also, the velocity of the carriage is allowed to change indpendent of the stylus movement. Because of this compensation, the carriage can be driven relatively rapidly when simple characters are being written and more slowly for more complex characters. In this way, the throughput of the machine can be substantially increased as compared with the situation which would exist if the speed of the carriage had to be kept constant, as would be the case if, for example, compensation were built into the vector encoding scheme. In such a case the single speed chosen would have to be relatively low, i.e. selected to permit sufficient time to write the most complex (and hence most time consuming) symbol.

The specification of carriage speed along a printing line is performed by the microprocessor system of FIG. 2. The illustrated microprocessor system provides a stream of data words representing the desired sequence of carriage speeds along the printing path. This carriage velocity data stream is output through the port 52. This data, available in the illustrated embodiment with five bits of accuracy, is applied to a digital-to-analog converter 111 over lines 112. The output signal from converter 111, which is an analog voltage representing desired speed, is compared with a voltage representing actual speed. This latter voltage is obtained by a frequency-to-voltage converter 113 driven by the pulse train from gate 91. As described previously, the pulse train is generated at a rate which is proportional to the velocity of the carriage, being derived from the shaft encoder associated with the carriage drive motor 27. The output voltages from the frequency-to-voltage converter 113 and the D/A converter 111 are applied, through respective mixing resistors 114 and 115, to a summing junction 116 to derive an error signal. The error signal is applied to an amplifier 117. The amplified error signal over line 118 drives a power amplifier 123, which in turn drives the servomotor 27.

As noted above, in the preferred embodiment, there is associated with each symbol vector definition a velocity or time designation which is representative of the time required to write the symbol in a standard size format. This corresponds to the maximum carriage velocity associated with the standard size symbol. The symbol vector definition also contains data representing the extent of the symbol in the standard size format. The microprocessor system of FIG. 2 uses both the time/-velocity designator and the standard size data to control the velocity of the carriage as it moves across the platen along the printing path. Thus, the carriage speed need not be determined solely by the time it takes to write the most complex symbol, but can and is varied according to the particular symbols being written.

In any implementation of the writing system described herein, the physical parameters of the system dictate the maximum possible carriage velocity change rates. Thus, in the particular system disclosed herein, the velocity of the carriage can vary between zero and six inches per second and can be changed by, for example, one-half inch per second in a "distance-velocity" increment of carriage travel. The spatial extent of the "distance-velocity" increment will vary from embodiment to embodiment and depends upon the mechanical drive system. It is convenient in the illustrated embodiment to designate the carriage velocity commands in one-half inch per second velocity increments (this is the five-bit data over lines 112). There are therefore thirty-two possible forward velocities at which the carriage can be designated to move, of which twelve are employed in the illustrated embodiment.

(This is effectively a filtering or smoothing process whereby the acceleration of the mechanical drive system is controlled electrically. The method can also be employed to limit acceleration beyond the limitations imposed by the physical system. This is desireable, for example, when mechanical noise and vibration must be limited, or where, for practical reasons, rolling off of servomechanism response is not feasible.)

Clearly, in order to increase throughput of the apparatus, it is desirable to move the carriage at as high an average velocity as possible. This is accomplished by the microprocessor system of FIG. 2 by "looking ahead" to determine whether any maximum velocities in future distance velocity increments will be adversely affected by the present velocity. The goal is to achieve and maintain as high a carriage velocity as possible, in view of the system mechanical dynamics and the restrictions on future velocities.

The illustrated system is limited so that the velocity can change in only one-half inch per second increments in each distance-velocity increment. This limitation, given the mechanical limits of the system, is set by the minimum time to traverse a "distance-velocity" increment. The microprocessor system then looks ahead to determine the velocity change factors as symbols are applied to the operating system of FIG. 2. The microprocessor system of FIG. 2 can either determine the velocities to be used for a line segment on demand (as the line is being printed) or can compute the velocity profile of a whole print line, prior to printing the line. In the preferred embodiment of the invention, it is the former approach which is employed. Further, the system employs the positional feedback provided by shaft encoder 37 and the decode circuitry of FIG. 3 (in particular the output of exclusive OR gate 91), as described in detail below.

Before proceeding with the details of the implementation of the variable speed carriage movement, it is convenient to introduce some definitional conveniences in order to describe both the limitations upon carriage velocity and upon the symbols being written. The spatial duration of each symbol is the symbol domain. For each of the symbols in a printing line, the symbol domain need not be constant, i.e. the symbols can have different spatial extends along the printing path, although in many instances the symbol domain is the same for each symbol. In the definition of the vector defining the standard symbols size, there is, as noted above, a definition of the spatial extent of the symbol domain. This spatial extent is given in terms of unit steps, one unit step in the printing path direction corresponding to a single pulse at the output of either gate 82 or 83. (In the illustrated embodiment, this corresponds to 1/240 inches.)

The spatial extent required to change the carriage velocity by an incremental known amount, one-half inch per second in the illustrated embodiment, is defined as the distance-velocity increment. (This term was introduced above.) In the illustrated embodiment, the distance-velocity increment corresponds to eight pulses from the output of either gate 82 or 83, of 1/30 inches.

According to the illustrated embodiment, a "look ahead" approach is implemented to determine whether the present carriage velocity can be increased, can stay the same, or must be decreased to meet a future maximum velocity requirement. Therefore, the example, when the carriage is moving at its greatest velocity, six inches per second in the illustrated embodiment, the apparatus must look ahead at the next twelve distance-velocity increments to determine whether the velocity can remain constant at its maximum or must be decreased. Thus, for example if at the symbol corresponding to the twelfth next distance velocity increment the carriage velocity must be reduced to zero. the velocity decrease must start immediately and the carriage velocity is decremented by one-half inch per second.

Figures 4, 8:
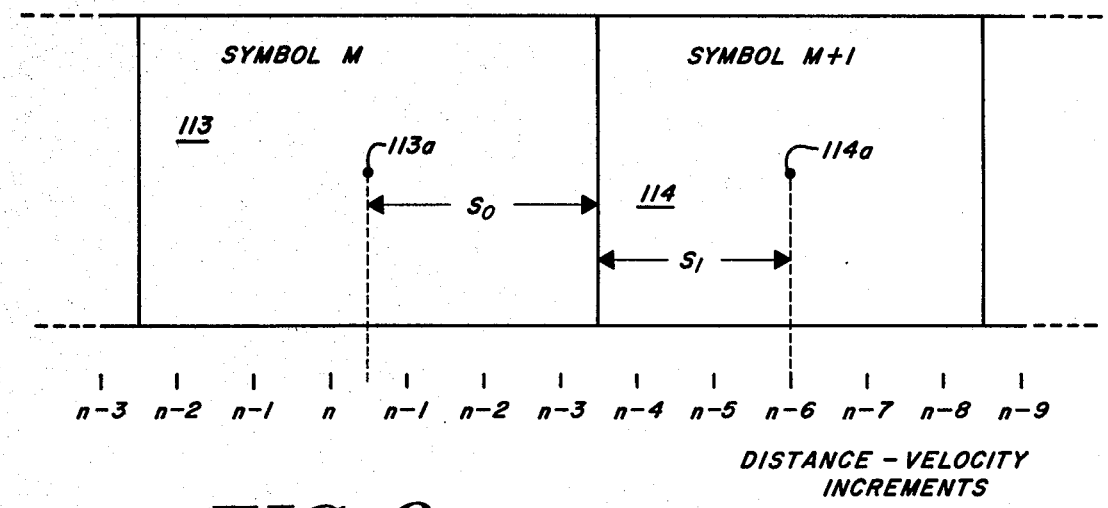
FIG. 4 is a diagram of the look-ahead velocity-change chart used in connection with the invention.
FIG. 8 is a pictorial diagram to aid in understanding the method for generating maximum carriage velocity along the printing path.

In order to enable a rapid determination of the optimum carriage velocity profile along the printing line, that is, the carriage velocity at each distance velocity increment along the printing line, a look-up table 124 (FIG. 4) is employed. The look-up table provides a data information value which indicates whether the velocity can or must change or can remain constant. The data information value depends upon the maximum velocity allowable during the carriage transit of some future distance-velocity increment. The chart of FIG. 4 is preferably incorporated into the microprocessor system through either the random access memory 45 or through a ROM attached to bus 41. In the illustrated embodiment, the chart is implemented in one of ROM's 46–49. Alternately, however, a separate hardwired apparatus can be employed wherein the microprocessor 43 applies a data signal to the hardwired apparatus and the apparatus provides the necessary velocity change information to the microprocessor system.

The chart of FIG. 4 is constructed as follows. For each possible carriage velocity and for each distance-velocity increment up to twelve increments ahead, a value is entered indicating whether the carriage velocity can be increased (+1), can stay the same (0), or must decrease (−1). Thus, in the example above, if the carriage velocity is at its maximum, six inches per second, and the velocity twelve distance-velocity increments ahead must be zero, then the carriage velocity must decreased in the next distance-velocity increment. This is represented in the chart by a "−1" entry at 125*a*. On the other hand, for example, if the carriage velocity is three inches per second and the carriage velocity in the next increment must also be no greater than three inches per second, then as to the next distance-velocity increment, the carriage velocity cannot increase and must at least stay the same. This is indicated at 125*b*. It should be noted at this point that even through the velocity requirement represented at 125*b* requires no velocity change, the maximum carriage velocity at later distance-velocity increments may require that the carriage velocity be decreased.

Note that the chart of FIG. 4 represents only one-half of the possible velocity differences. It should be clear, and need not be recorded in detail in chart form, that if the velocity at a later distance-velocity increment is greater than the velocity of the carriage during the present distance-velocity increment, that the entry must be "+1". Thus, all of the entries which would occur "above" the zero difference velocity line 125*c* equal +1.

Figure 5:
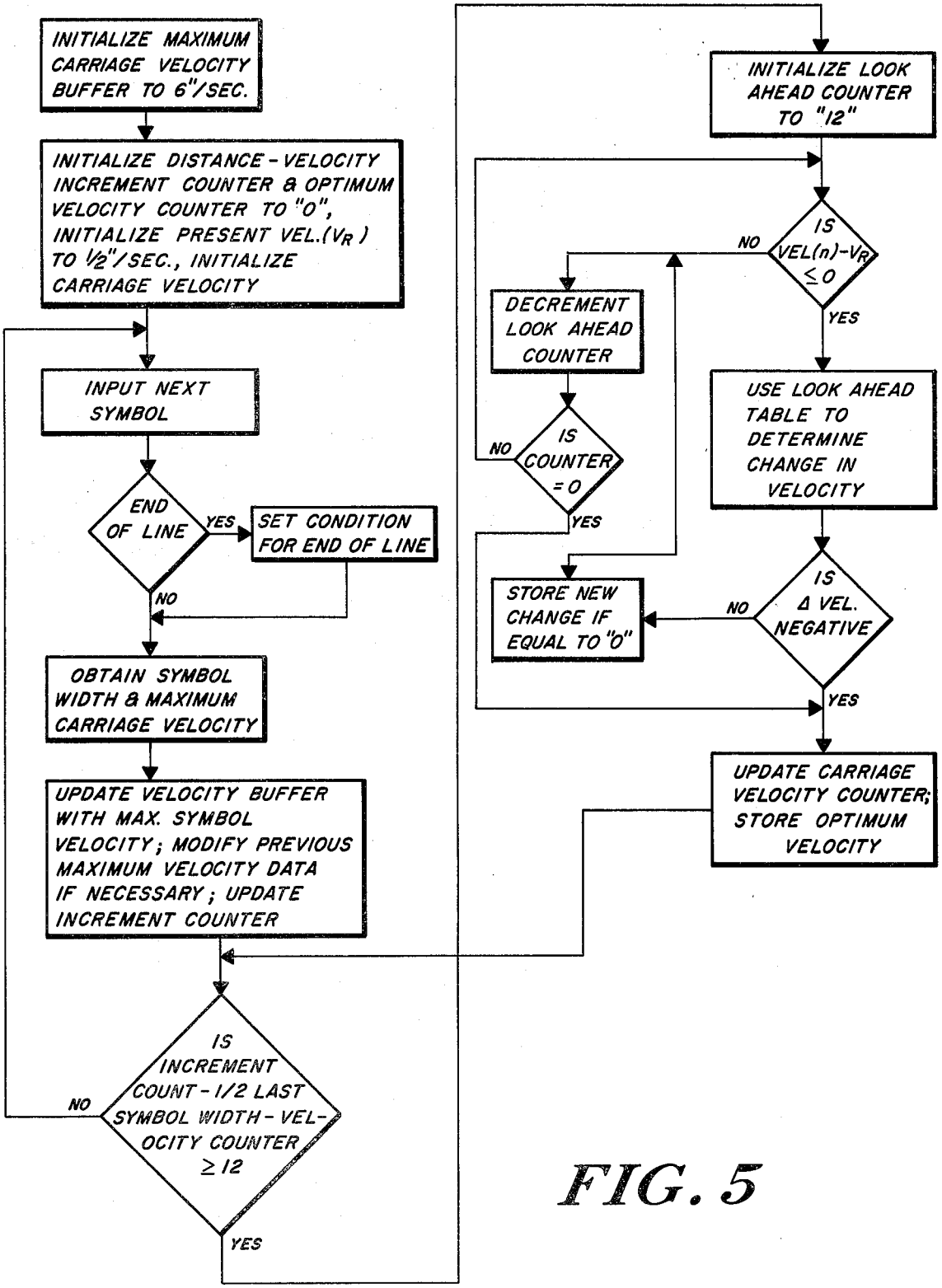
FIG. 5 is a flow chart representing a method for generating the carriage velocity changes according to the invention.
Figure 6:
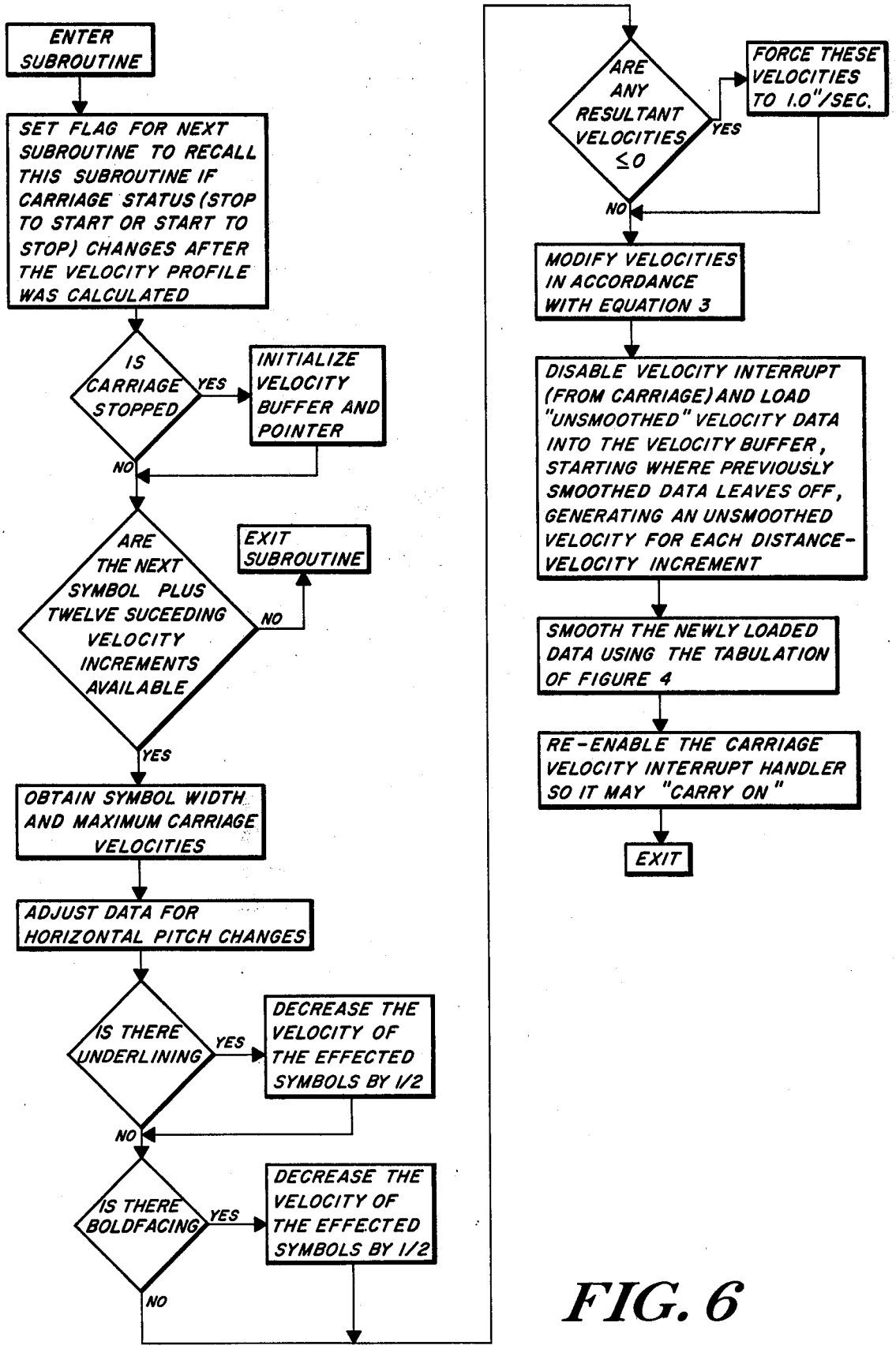
FIG. 6 is a flow chart representing a preferred method for generating the carriage velocity changes according to the invention.

As noted above, the velocity determinations can be performed either on demand (usually while the carriage is moving), or on a line by line basis prior to carriage movement for that line. In the preferred illustrated embodiment, the velocities are determined on demand (FIGS. 5 and 6). Thus, according to this embodiment, as the processor stores symbols to be printed in its memory 45, it generates for each successive distance-velocity increment a maximum velocity which can be employed as the carriage traverses the increment. This determination takes into account the horizontal spatial extent of each of the symbols involved, as described in more detail below in connection with FIG. 8. Thus each increment is "tagged" with a maximum velocity which depends upon the maximum velocity allowed for the symbol being written. As the maximum velocity profile is determined for each distance-velocity increment, an optimum velocity profile for the carriage is, if possible, also obtained employing the chart of FIG. 4 and the boundary conditions that the carriage is presently at a velocity $V_R$ (the present velocity) which can vary from increment to increment, and ends the velocity profile at a velocity of six inches per second (the velocity allowed when no symbol is printed). The optimal velocity for each successive increment is determined as soon as the maximum velocities for the next twelve increments and the present velocity for the last increment are known. (The "raw" maximum velocity information for this determination is stored, as noted above, in the ROM's 46, 47, 48, and 49 (which totally define the standard size symbol).)

Accordingly, therefore, starting at a "present" distance-velocity increment of the profile, in which the carriage has, for example, a maximum velocity of three inches per second, and a present velocity ($V_R$) of two inches per second, the microprocessor system of FIG. 2 looks ahead at the next twelve distance-velocity increments and, determines whether, for each of those twelve next increments, the velocity can be increased, can remain the same, or must be decreased. The chart look-up procedure employed for each of the twelve next increments, preferably starts at the twelfth or furthest increment, since it is most likely that the more distant increments, rather than a near increment, will tend to restrict the carriage velocity. If for any increment, the look-up table indicates that the velocity must be decreased, the look ahead search is terminated, the present velocity is decremented by one velocity unit, that is, one-half inch per second in the illustrated embodiment, and the entire procedure is updated starting with the next sequential distance-velocity increment. The "demand" method of operation is outlined generally in FIG. 5 and more particularly in FIG. 6 which represents a flow chart for a software subroutine for controlling this portion of processor 43 operation.

Once the "optimal" velocity has been determined for a distance-velocity increment, the microprocessor system of FIG. 2 updates the hardware and moves on to the next distance-velocity increment, where the next "optimal" velocity is determined. This process occurs as the line is being printed, and the carriage velocity data output is provided through output port 52 over line 112 to converter 111.

Figure 7:
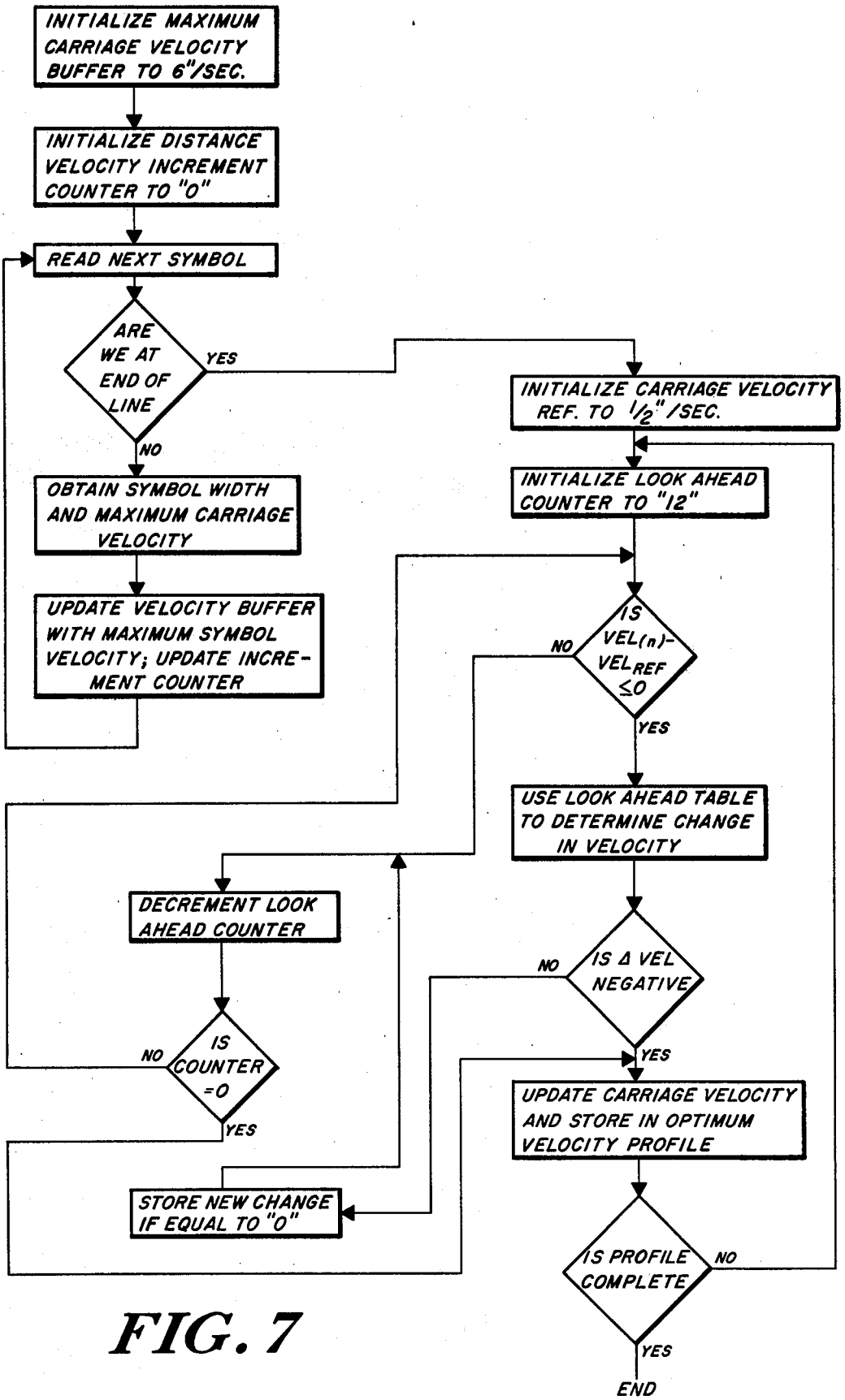
FIG.7 is a flow chart representing an alternate method for generating the carriage velocity changes according to the invention.

According to that embodiment of the invention wherein velocity determinations are made on a line-by-line basis prior to the beginning of carriage movement for a line, once the processor has stored in its memory 45 a set of symbols to be printed (corresponding to a full line), it generates in the random access memory 45, a corresponding list of maximum velocities which can be employed in each of the distance-velocity increments across the line. As in the demand mode embodiment, this determination takes into account the horizontal spatial extent of each of the symbols involved. Thus each increment is "tagged" with a maximum velocity which depends upon the maximum velocity allowed for the symbol being written. Once the maximum velocity profile is determined for a printing line, an optimum velocity profile for the carriage is obtained employing at each distance-velocity increment, the chart of FIG. 4 and the boundary conditions that the carriage starts from a stationary condition and ends the line at the maximum velocity possible. This method of operation according to this embodiment is outlined in FIG. 7 which represents a flow chart for this portion of processor 43 operation according to this embodiment of the invention.

Once the entire "optimal" velocity profile has been determined for a printing line according to the line-by-line method, the microprocessor system of FIG. 2 is ready to print the line. While the line is being printed, the carriage velocity data output is provided through output port 52 over line 112 to converter 111. Simultaneously, the next line of symbols are being or have been input to the microprocessor memory and the optimum velocity profile for the next full line is determined.

As noted above, prior to determining the "optimal" velocity profile for either an entire printing line or segment of a line (i.e. the demand mode), the maximum velocity for each distance-velocity increment is determined. In most instances, the maximum velocity will be a sole function of the symbol being printed when the carriage is to traverse the particular distance-velocity increment. There are instance however, when the maximum velocity must be modified to take into account different spatial durations associated with adjacent symbols.

Referring to FIG. 8, two adjacent symbols, symbol m and symbol m+1, are printed in respective domains 113 and 114. Domain 113 has a center 113*a* positioned at the middle of the $n^{th}$ distance-velocity increment and domain 114 has a center 114*a* positioned at the beginning of increment n+6. The spatial duration of the respective domains 113 and 114 are different. Domain 113 extends for six distance-velocity increments in the illustrated embodiment and domain 114 extends for five distance-velocity increments in the illustrated embodiment. Further, it is assumed that other things being equal, the maximum velocity of the carriage during printing of symbol m, $V_m$, is different than the maximum velocity of the carriage when printing symbol m+1, that is $V_{m+1}$.

According to the preferred embodiment of the invention, the carriage is positioned at the center of a symbol domain when writing of the symbol begins. Thus, at the instant when symbol m "printing" begins, the carriage is at the middle of distance-velocity increment n, that is, at the center 113*a* of symbol m. Since the maximum velocity of the carriage is set to traverse a distance about equal to the full width of symbol m, as the symbol is being written, and since the carriage begins its motion at the center 113*a* of symbol m, the carriage will move past and be downstream of the center of symbol m+1 at the time when the writing of symbol m is complete. This is an unacceptable operating condition since it is assumed that the carriage is located at the center of a symbol when the symbol writing begins. (Here the carriage has already traveled past the center of the next symbol, symbol m+1.) As a result, the maximum carriage velocity for the distance-velocity increment associated with symbol m must be reduced below that which would be otherwise acceptable. This modification of system velocity is accomplished according to an averaging formula. The formula employed (and its derivation) in the illustrated embodiment is (referring to FIG. 8):

$$T_1 = 2S_0/V_{max} \qquad \text{Equation 1}$$

$$T_1 = (S_0 + S_1)/V \qquad \text{Equation 2}$$

Therefore, equating the right side of equations 1 and 2:

$$V = (V_{max}/2)(1 + S_1/S_0) \qquad \text{Equation 3}$$

where $V \leqq V_{max}$ and where $S_0$ is one-half the width of the first domain, domain 113; $S_1$ is one-half the width of the second domain, domain 114; $V_{max}$ is the maximum velocity associated with first symbol m; V is the maximum available velocity when symbol domains 113 and 114 are adjacent one another; and $T_1$ is the time it takes to write symbol m, which thereby defines $V_{max}$, given the width of symbol domain 113.

By reducing the maximum velocity, if necessary, to "V", the extent of travel of the carriage will be limited so that a next adjacent symbol, symbol m+1 in the illustrated embodiment, will begin at its domain center. It should further be noted that a single distance-velocity increment can be associated with one of two different symbols (such as distance-velocity increment n) when two symbol domains overlap the same distance-velocity increment, the maximum velocity associated with that increment is no greater than the smaller maximum velocity of the two symbols.

Referring now to FIG. 3, in this illustrated embodiment, a distance-velocity increment is equal to and corresponds to eight pulses from the gate 82 or gate 83. (Typically a standard symbol will be three distance-velocity increments in width.) To enable the microprocessor system of FIG. 2 to operate more efficiently, a modulo 8 counter 125*d* (FIG. 3) provides an output pulse over a line 125*e* to the processor 43 through port 53. At each pulse over line 125*e*, the processor updates the carriage velocity control signals over lines 112.

The illustrated embodiment includes provision for easily forming symbols of different sizes from the same font defining vector data, that is, from a single set of digital data applied to the digital-to-analog converters 61 and 63 over lines 65 and 67 respectively. For this purpose, the converters 61, 63 are of the so-called multiplying type in which the output voltage is proportional, not only to the digital value applied, but also to an applied analog reference voltage. A four bit data word, obtained from the microprocessor controller of FIG. 2, is applied over lines 126 to a decoder 127. Decoder 127 generates two separate one-of-four selection signals, each selection signal being defined by two of the bits over lines 126. Each selection signal is applied to a respective quad switch 128 and 129 to select one of four predetermined voltages for application, as a reference voltage, to the respective digital to analog converter 61 or 63. The predetermined voltages are obtained from a voltage divider comprising resistors 131, 133, 135 and 137. The resistors 131, 133, 135 and 137 are selected to produce voltages corresponding to the desired type sizes rather than to perform a normal digital-to-analog coversion. The nature of the decoding is such that only one switch in each of the packages is on at any one time so that the reference voltage applied to each digital-to-analog converter 61 or 63 can be independently selected. Accordingly, since the horizontal and vertical scaling factors can be selected separately, characters of different aspect ratios can be formed from the same "raw" vector data as well as merely scaling the characters. In the preferred embodiment, the two digital-to-analog converters are not identical in their scaling ratios.

In the illustrated embodiment, the axis of one of the linear servomechanisms driving the stylus is parallel to the direction of carriage movement and the other axis is essentially perpendicular thereto. Accordingly, the carriage displacement based compensation signal over line 81 only needs to be mixed with one of the two control signals driving the stylus servomechanisms to obtain the desired moving frame of reference. On the other hand, those skilled in the art will appreciate that an arrangement could be utilized in which the axes of the linear servomechanisms are at an angle, e.g., 45° to the direction of carriage movement. In such a case, displacement compensation components of appropriate magnitude would be summed with each of the servocontrol signals, observing appropriate polarity. In fact, the axes of the stylus servomechanisms need not be perpendicular to each other. The specification of the resulting compensation is more complex in that circumstance; however, such an arrangement should be understood to be within the scope of the present invention. Similarly, it should also be understood that it is relative motion between the platen and the stylus mount which is significant and that either component might actually be moved even though movement of the stylus mount (carriage) is disclosed in the preferred embodiment.

In the illustrated embodiment, during operation in the "demand" mode, it has been tacitly assumed (in FIG. 5) that a continuous stream of data was available so that the velocity profile can be constantly updated and determined. When the input source is a typewriter, this is not the case. Furthermore, it is important when the apparatus is employed in connection with a typewriter type input, that the carriage position be constantly updated to provide a substantially immediate feedback to the operator in the same manner as a typical electric typewriter, such as the IBM Selectric typewriter, provides. Consequently, in the demand mode, when the typewriter input is employed, the boundary conditions are changed to allow for the continuous velocity and to provide for a constant update of carriage position as illustrated in FIG. 6.

The presently preferred embodiment of the invention, implemented in accordance with the processing system of FIG. 2, employs computer programs to realize various aspects of the apparatus. The detailed programs which provide the functions described in relation to the flow chart of FIG. 6 are set forth in the attached Appendix A. The program printout is in the basic assembly language used in connection with the Intel 8085A-2 microprocessor. Appendix A is the operating subroutine program employed in connection with determining the maximum velocity profile and the optimal velocity provided in accordance with the preferred embodiment of the invention. Those skilled in the programming art will be able to follow the programming and generate alternate operating programs and apparatus in accordance with the invention. The program is heavily annotated to enable one skilled in the programming art to follow the processing of the incoming data information.

Additions, subtractions, deletions and other modifications of the preferred embodiment are within the skill of one practiced in the art and are within the scope of the following claims.

APPENDIX A

VARIABLE DEFINITIONS

VELREF: (byte), a byte indicating the present carriage velocity. It assumes the values of OOH through OCH for velocities of 0.0"/sec respectively, in velocity increments of 0.5"/sec.

TYPCAL: (byte), a byte indicating what the velocity of the carriage was at the time the velocity profile was calculated. In reality, it is used by the following routine (called "BACKUP") as an indicator of whether the carriage was "ON" during the velocity calculation or not. The reason . . . if the carriage has gone from "on" to "off" between the time the profile was calculated and the printing time of the characters, then the profile must be re-calculated.

ABSHGHPORT: (byte), a port that reports the high nibble of the 12-bit carriage position:

| | | | | | | | |
|---|---|---|---|---|---|---|---|
| BO | X | X | X | $P_{11}$ | $P_{10}$ | $P_9$ | $P_8$ |

B0=The row encoder pulses, squared, of B0
X=don't cares
**Pr=carriage position bits
**P=Carriage position bits
**L.S.B.=1/240" for a 13.2" carriage w/½" margins as well.

ABSLOWPORT: (byte), a port that reports the low byte of the 12-bit carriage position:

| | | | | | | | |
|---|---|---|---|---|---|---|---|
| $P_7$ | $P_6$ | $P_5$ | $P_4$ | $P_3$ | $P_2$ | $P_1$ | $P_0$ |

LSTPOS: (word), a note of the carriage position, so that "VELCAL" can calculate a new profile from that position, onward.

VELPTR: (word), a pointer into the velocity buffer, pointing to the next speed value to output to the carriage controlling port . . . updated by the velocity interrupt routine ("INTVEL") every 8 encoder pulses.

LSTPTR: (word), a pointer into the velocity buffer, pointing to the last valid entry made by "VELCAL".

IBFPTR: (word), pointer into the data input buffer. Points to printable character data (and spaces).

TCHRPTR: (word), a pointer set up by "DOMCAL" to point to the character segment data for the next character to print.

TCHRCNT: (byte), the number of segment bytes (plus 1) of the next character's data. (Value=02H to FFH)

BCKFLG: (byte), used as a flag to force "DOMCAL" or "SPACE" routines to make their respective calculations and then to either return immediately with the results or to use the results to alter system variables:
=FFH, return to the calling routine with results for caller disposition of them.
=OOH, return to the caller after the results are used to modify system variables.
These routines basically return to "VELCAL" with the domain value of the character they processed.

DATTBL: (words), a table whereby "VELCAL" can temporarily store the speed and domain size of the necessary number of characters to do a profile. This table is "massaged" as the speed bytes and domain values are modified per pitch, bolding, underlining, etc., changes.

INBUF: (bytes), the data input buffer.

LCAPOS: *(word), the last absolute carriage position where a character (or space) was started.

LHDVAL: *(word), the value of ½ of the domain of the last character (or space) that was started.

TAKE2S: (routine), calculates the 2's complement of the contents of the HL-register pair and returns it in HL register pair.

TRNFLG: (byte), a flag telling "DOMCAL" what to do with ASCII values encountered that do not represent printable characters.
=FFH, all ascii codes encountered are printable. If OOH→IFH or 80H→9FH encountered, then use segment data from the special transparent character set . . . other codes are as usual.
=OOH, ignore as character data codes of OOH→IFH or 80H→9FH.

TSTATUS: (word), a system status word. Holds flags indicating what special parameters are set on or off . . . i.e. . . . bold facing, italicizing, underlining, super/-subscripting, etc.

XSPDTBL: (bytes), a table to allow software to scale up/down a character's speed byte value, changes in pitch vary from 10 CPI to some other value.

XYREAL: (byte), a flag logging the pitch and point value the next character will be printed at.

*"LCAPOS" & "LHDVAL"=the carriage position where the next character is to begin.

DIVIDE: (routine), performs of 16÷16 bit binary divide (remainder is trounced!) of the HL÷BC.

VELTBL: (bytes), a table that enables the software to lock up the velocity value between speed bytes to effect a "smoothed" profile.

SLWFLG: (byte), a flag, set on (FFH) if the carriage is presently undergoing a reverse slew (carriage return). This is useful because velocity interrupts are unwanted at this time since it is constant.

INTVEL: (routine), this routine (started by an RST6.5 interrupt is forced alive every 8 encoder pulses (30.0 mils). Its function is to output the next speed byte to the carriage control hardware, as pointed to by "VELPTR" into "VELBUF".

```
VELCAL: MICROBENCH 8080/8085 CROSS ASSEMBLER (V2)-26

                                        NAME VELCAL
                                ;
                                ;       SMOOTHED VELOCITY PROFILE PROCEEDURE
                                ;
                                        ENABL   LSB
                                ;
                                ; THIS ROUTINE EXECUTES THE PROCEEDURES NECCESSARY TO OBTAIN A CARRIAGE
                                ; VELOCITY PROFILE BASED ON THE CHARACTERISTICS OF THE LINE DATA ... BE IT
                                ; PRINTABLE ASCII OR SLEWING. IT COMPENSATES FOR SCALING, PROPORTIONAL-
                                ; IZATION AND OTHER FACTORS ALTERING CARRIAGE SPEED. IT OPTIMIZES THE SPEED
                                ; FOR MAXIMUM THROUGH-PUT BASED ON A UNIQUE CHARACTER LOOK-AHEAD CONCEPT.
                                ;
 0000                           VELCAL:
 0000   3A      0000G                   LDA     VELREF          ; NOTE THE PRESENT VALUE OF "VELREF" FOR
 0003   32      0000G                   STA     TYPCAL          ; OURSELVES LATER AND "BACKUP" LATER.
 0006   B7                              ORA     A               ; IS THE CARRIAGE STOPPED AT THE MOMENT ... ?
 0007   C2      0033                    JNZ     20$             ; BRANCH IF NOT, PERFORM ON THE FLY.
 000A   DB      00  G                   IN      ABSHGHPORT      ; GET OUR PRESENT POSITION AN STORE
 000C   E6      0F                      ANI     ^B00001111      ; IN 'LSTPOS' FOR NOW UNTIL NEEDED.
 000E   FE      0E                      CPI     ^H0E            ; REMEMBER TO MAKE THE 12-BIT COUNTER INTO A
 0010   DA      0015                    JC      5$              ; FULL 16-BIT 2'S COMPLEMENT NUMBER.
 0013   F6      F0                      ORI     ^HF0            ; ...
 0015                           5$:
 0015   32      0001G                   STA     LSTPOS+1        ; ...
 0018   DB      00  G                   IN      ABSLOWPORT      ; ...
 001A   32      0000G                   STA     LSTPOS          ; ...
 001D   21      0000G                   LXI     H,VELBUF        ; INIT THE BUFFER AND POINTERS.
 0020   22      0000G                   SHLD    VELPTR          ; ALSO OUR ACTIVE VELOCITY BUFFER POINTER AND
 0023   22      0000G                   SHLD    LSTPTR          ; POINTER TO LAST STORED VELOCITY IN BUFFER.
 0026   01      021B                    LXI     B,^H021B        ; INIT MARGIN AS WELL ... ALL TO 1.0" PER SEC.
 0029   16      02                      MVI     D,^H02          ; (THE PORT'S 1.0"/SEC VALUE) ...
 002B                           10$:
 002B   72                              MOV     M,D             ; STORE ...
 002C   23                              INX     H               ; UPDATE "VELBUF" POINTER ...
 002D   0B                              DCX     B               ; UPDATE BYTE COUNTER ...
 002E   78                              MOV     A,B             ; BUFFER ALL FILLED ... ?
 002F   B1                              ORA     C               ; ...
 0030   C2      002B                    JNZ     10$             ; LOOP BACK IF NOT DONE YET.
 0033                           20$:
 0033   2A      0000G                   LHLD    IBFPTR          ; SAVE THE INPUT DATA BUFFER POINTER AND
 0036   E5                              PUSH    H               ; ALTER IT TO POINT BACK TO THE CHARACTER THAT
 0037   2B                              DCX     H               ; "DOMCAL" OR "SPACE" HAD JUST WORKED ON.
 0038   22      0000G                   SHLD    IBFPTR          ; IF A COMMAND, WE'LL KNOW LATER.
 003B   2A      0000G                   LHLD    TCHRPTR         ; SAVE THE SEGMENT DATA POINTER FOR "PUTPAR" ...
 003E   E5                              PUSH    H               ; ...
 003F   3A      0000G                   LDA     TCHRCNT         ; SAVE THE SEGMENT DATA COUNT ...
 0042   F5                              PUSH    PSW             ; ...
 0043   3E      FF                      MVI     A,^HFF          ; INIT "BCKFLG" FOR "DOMCAL" AND "SPACE"
 0045   32      0000G                   STA     BCKFLG          ; TO RETURN HERE WITH RESULTS.
 0048   01      0000G                   LXI     B,DATTBL        ; TOP OF DATA TABLE BUFFER.
 004B   21      0000                    LXI     H,^H0000        ; INIT THE CUMULATIVE DOMAIN SUM AND
 004E   E5                              PUSH    H               ; SAVE ON STACK SO WE CAN GET AT IT.
 004F   3A      0000G                   LDA     SLWFLG          ; NOW, ARE WE PRESENTLY REVERSE SLEWING ... ???
```

VELCAL: MICROBENCH 8080/8085 CROSS ASSEMBLER (V2)-26

```
0052  B7                    ORA   A                 ; ... ???
0053  CA   005D             JZ    25$               ; BRANCH IF FALSE, WE CAN DO A PROFILE.
0056  3A   0000G            LDA   TYPCAL            ; OKAY, WE WERE REVERSE SLEWING, BUT ARE WE
0059  B7                    ORA   A                 ; STILL IN THE PROCESS OF SUCH ... ???
005A  C2   031B             JNZ   ABOVEL            ; ABORT IF SO, CAN'T MAP PROFILE YET !!
005D                 25$:
005D  3A   0001G            LDA   TSTATUS+1         ; FIND OUT IF 'THIS' OBJECT PROFILE IS FOR
0060  E6   20               ANI   ^B00100000        ; A SLEW TYPE ... 'SLEW' OR 'SPACE' ...
0062  C2   0096             JNZ   30$               ; BRANCH IF NOT, NORMAL POCESSING ...
0065  2A   0000G            LHLD  IBFPTR            ; RESTORE THE INPUT BUFFER POINTER SINCE THIS
0068  23                    INX   H                 ; MAY HAVE BEEN A COMMAND OR 'SEQUENCE' OF
0069  22   0000G            SHLD  IBFPTR            ; 'SPACE' CHARACTERS.
006C  2A   0000G            LHLD  LCAPOS            ; DETERMINE IF PROFILE CAN BE MAPPED, SINCE
006F  EB                    XCHG                    ; ONLY FORWARD MAPS ARE LEGAL, REVERSES NOT !
0070  2A   0000G            LHLD  LHDVAL            ; [NCAPOS + NHDVAL - (LCAPOS+LHDVAL)]
0073  19                    DAD   D                 ; IF POSITIVE, WE CAN LEGALLY MAP ...
0074  CD   0000G            CALL  XTAKE2S           ; ...
0077  EB                    XCHG                    ; ...
0078  2A   0000G            LHLD  NCAPOS            ; ...
007B  19                    DAD   D                 ; ...
007C  EB                    XCHG                    ; MORE THAN LIKELY THIS IS ALL ZEROS, BUT
007D  2A   0000G            LHLD  NHDVAL            ; TO BE PURE, AND AVOID POSSIBLE BUGS, ADD
0080  19                    DAD   D                 ; THE HALF DOMAIN VALUE IN AS WELL !!
0081  3E   80               MVI   A,^B10000000      ; IF THE RESULT NEGATIVE, WE MUST ABORT FOR NOW
0083  A4                    ANA   H                 ; SINCE IT WOULD BE REV. MAP, BUT 'BACKUP' WILL
0084  C2   031B             JNZ   ABOVEL            ; EVENTUALLY POINT US BACK TO HERE LATER !
0087  22   0001G            SHLD  DATTBL+1          ; STORE THE UN-NORMALIZED SLEWING DOMAIN ...
008A  3E   8C               MVI   A,^H8C            ; ALSO FLAG (WITH BIT #8) THAT IT'S A SLEW AND
008C  32   0000G            STA   DATTBL            ; USE MAX FORWARD SPEED.
008F  EB                    XCHG                    ; PUT INTO <DE> TO FALL INTO COMMON CODE.
0090  01   0003G            LXI   B,DATTBL+3        ; SET 'DATTBL' POINTER TO ENTRY BEYOND 'OBJECT'.
0093  C3   0117             JMP   60$               ; FALL INTO REGULAR CODE AND PICK UP THE REST.
0096                 30$:
0096  2A   0000G            LHLD  IBFPTR            ; GET A CHARACTER ...
0099  7E                    MOV   A,M               ; ...
009A  E6   7F               ANI   ^H7F              ; REMOVE ANY 8th-BIT ASCII STUFF.
009C  B7                    ORA   A                 ; END OF THE DATA INPUT BUFFER ... ?
009D  CA   012D             JZ    NORMAL            ; BRANCH TO NORMALIZATION IF BUFFER EMPTY.
00A0  FE   20               CPI   ^H20              ; IS THIS A JOB FOR "SPACE" ... ?
00A2  C2   00CD             JNZ   50$               ; BRANCH IF A JOB FOR "DOMCAL".
00A5  3A   0000G            LDA   TRNFLG            ; IS THE TRANSPARENT MODE ON ... ?
00A8  B7                    ORA   A                 ; ... ?
00A9  C2   00CD             JNZ   50$               ; BRANCH TO "DOMCAL" IF IT IS ON.
00AC  23                    INX   H                 ; UPDATE THE INPUT BUFFER POINTER HERE CAUSE
00AD  22   0000G            SHLD  IBFPTR            ; "SPACE" VIA "BCKFLG" DOESN'T DO IT.
00B0  C5                    PUSH  B                 ; SAVE POINTER INTO "DATTBL".
00B1  CD   0000G            CALL  XSPACE            ; LET "SPACE" DETERMINE THE DOMAIN VALUE.
00B4  C1                    POP   B                 ; RESTORE THE "DATTBL" POINTER.
00B5  3E   8C               MVI   A,^H8C            ; DEFINE THE SPEED TO BE 6.0"/S.
00B7  02                    STAX  B                 ; AND STORE IN "DATTBL".
00B8  3A   0000G            LDA   TSTATUS           ; IS UNDERLINING TO BE PERFORMED ... ?
00B8  E6   40               ANI   ^B01000000        ; ...
00BD  CA   00C3             JZ    40$               ; BRANCH IF NOT ...
00C0  3E   86               MVI   A,^H86            ; ELSE WE MUST DERATE THE SPEED BY HALF.
00C2  02                    STAX  B                 ; AND STORE IN "DATTBL".
00C3                 40$:
00C3  03                    INX   B                 ; UPDATE THE "DATTBL" POINTER TO DOMAIN ENTRY.
```

VELCAL: MICROBENCH 8080/8085 CROSS ASSEMBLER (V2)-26

```
00C4   78                          MOV     A,E          ; GET LOW DOMAIN BYTE FROM "SPACE" ...
00C5   02                          STAX    B            ; AND STORE.
00C6   03                          INX     B            ; POINT TO HIGH BYTE SLOT.
00C7   7A                          MOV     A,D          ; GET HIGH DOMAIN BYTE FROM "SPACE" ...
00C8   02                          STAX    B            ; AND STORE.
00C9   03                          INX     B            ; UPDATE TO NEXT ENTRY'S SPEED BYTE SLOT.
00CA   C3      0117                JMP     60$          ; AND DO THE CHECK FOR DATA STOP.
00CD                     50$:
00CD   C5                          PUSH    B            ; SAVE POINTER INTO "DATTBL".
00CE   CD      0000G               CALL    XDOMCAL      ; DETERMINE DOMAIN FOR THE CHARACTER.
00D1   2A      0000G               LHLD    TCHRPTR      ; GET SEGMENT DATA POINTER FROM "DOMCAL".
00D4   2B                          DCX     H            ; POINT TO THE CHARACTER'S SPEED BYTE.
00D5   3A      0000G               LDA     TSTATUS      ; GET THE PROP/MONO STATUS BIT IN REGISTER ...
00D8   E6      02                  ANI     ^B00000010   ; IS PROPORTIONAL SELECTED ... ??? ...
00DA   7E                          MOV     A,M          ; (GET THE COMBO-SPEED BYTE) ...
00DB   C2      00E2                JNZ     53$          ; BRANCH IF PROPORTIONAL IS SELECTED.
00DE   0F                          RRC                  ; ELSE, SHIFT THE MONO-SPEED NIBBLE DOWN
00DF   0F                          RRC                  ; TO THE LOW NIBBLE POSITION ...
00E0   0F                          RRC                  ; ...
00E1   0F                          RRC                  ; ...
00E2                     53$:
00E2   E6      0F                  ANI     ^B00001111   ; MASK OUT ALL BUT THE CORRECT SPEED VALUE.
00E4   17                          RAL                  ; SCALE BYTE FOR H. PITCH CHANGES FROM 10 cpi.
00E5   17                          RAL                  ; ...
00E6   E6      3C                  ANI     ^B00111100   ; USE TO INDEX INTO ROW OF "SPDTBL".
00E8   4F                          MOV     C,A          ; ...
00E9   06      00                  MVI     B,^H00       ; ...
00EB   2A      0000G               LHLD    XSPDTBL      ; GET BASE ADDRESS OF THE SPEED SCALING TABLE.
00EE   09                          DAD     B            ; AND POINT TO THE PROPER ROW.
00EF   3A      0000G               LDA     XYREAL       ; NOW, GET THE SCALING FACTOR TO FIND COLUMN.
00F2   E6      03                  ANI     ^B00000011   ; MASK OFF THE Y-AXIS SCALING BITS.
00F4   4F                          MOV     C,A          ; MAKE INTO OFFSET ADDRESS ...
00F5   09                          DAD     B            ; ...
00F6   46                          MOV     B,M          ; AND GET THE SCALED BYTE !
00F7   3A      0000G               LDA     TSTATUS      ; NOW, IS THERE UNDERLINING ... ?
00FA   E6      40                  ANI     ^B01000000   ; ...
00FC   78                          MOV     A,B          ; ...
00FD   CA      0102                JZ      55$          ; BRANCH IF NOT.
0100   B7                          ORA     A            ; ELSE, CUT THE SPEED BY ONE HALF ...
0101   1F                          RAR                  ; ...
0102                     55$:
0102   47                          MOV     B,A          ; AND STORE AGAIN.
0103   3A      0000G               LDA     TSTATUS      ; IS THERE BOLDFACING ... ?
0106   17                          RAL                  ; ... ???
0107   78                          MOV     A,B          ; ... ???
0108   D2      010D                JNC     57$          ; BRANCH IF NOT.
010B   B7                          ORA     A            ; ELSE DERATE SPEED BY ONE HALF ...
010C   1F                          RAR                  ; ...
010D                     57$:
010D   B7                          ORA     A            ; IS THE RESULTANT SPEED LESS THAN 1/2"/S ?
010E   C2      0112                JNZ     59$          ; BRANCH IF NOT, WE HAVE A NON-ZERO SPEED.
0111   3C                          INR     A            ; ELSE FORCE SPEED TO BE AT LEAST 1/2" PER SEC.
0112                     59$:
0112   C1                          POP     B            ; RESTORE POINTER INTO "DATTBL" ...
0113   02                          STAX    B            ; AND STORE THE CHARACTER'S SCALED SPEED VALUE.
0114   C3      00C3                JMP     40$          ; NOW, ALSO DEPOSIT THE DOMAIN DETERMINED.
0117                     60$:
```

VELCAL; MICROBENCH 8080/8085 CROSS ASSEMBLER (V2)-26

```
0117   E1                          POP     H              ; RETRIEVE THE DOMAIN TOTAL SUM REGISTER.
0118   19                          DAD     D              ; ADD THE PRESENT DOMAIN VALUE TO IT.
0119   E5                          PUSH    H              ; AND SAVE IT AGAIN.
011A   EB                          XCHG                   ; HOLD THE DOMAIN TOTAL IN <DE> WHILE
011B   2A      0001G               LHLD    DATTBL+1       ; WE GET THE OBJECT DOMAIN THAT WE ARE
011E   CD      0000G               CALL    XTAKE2S        ; AFTER HERE AND MAKE IT NEGATIVE TO
0121   19                          DAD     D              ; SUBTRACT IT FROM THE TOTAL DOMAIN
0122   7C                          MOV     A,H            ; COUNT. NOW, IF WE HAVE DATA ENOUGH
0123   B7                          ORA     A              ; FOR 12 VELOCITY INTERRUPTS BEYOND THE
0124   C2      012D                JNZ     NORMAL         ; END OF THE OBJECT DOMAIN, THEN WE
0127   3E      5F                  MVI     A,^D95         ; HAVE ENOUGH DATA TO BEGIN THE PROFILE
0129   95                          SUB     L              ; NORMALIZATION PROFILE. OTHERWISE, WE
012A   F2      0096                JP      30$            ; MUST OBTAIN DATA UNTIL WE DO !
012D                       NORMAL:
012D   E1                          POP     H              ; RESTORE THE STACK BY REMOVING DOMAIN TOTAL.
012E   3E      02                  MVI     A,^H02         ; SET-UP DUMBY DOMAIN AND SPEED OF
0130   02                          STAX    B              ; 1.0 " PER SEC, INCASE THER WASN'T ENOUGH
0131   03                          INX     B              ; DATA IN THE CHARACTER INPUT BUFFER FOR
0132   AF                          XRA     A              ; FULL 12 INTERUPTS BEYOND 'OBJECT' AND GIVE
0133   02                          STAX    B              ; IT A DOMAIN OF ZERO TO FLAG AN
0134   03                          INX     B              ; EFFECIVE RAMP DOWN AT THE END. THIS WILL
0135   02                          STAX    B              ; ONLY SLOW THE CARRIAGE DOWN IF THERE'S NOT
0136   03                          INX     B              ; ENOUGH DATA IN THE INPUT BUFFER.
0137   02                          STAX    B              ; ALSO, MARK THE END OF "DATTBL" DATA.
0138                       SCALSD:                        ; BEGIN SPEED AND DOMAIN SCALING AND
0138   21      0000G               LXI     H,DATTBL       ; BEGIN WITH THE 'OBJECT' DOMAIN.
0138                       65$:
0138   7E                          MOV     A,M            ; OBTAIN V(0), V(1), S(0), & S(1) FOR THE
013C   32      0000G               STA     VELO           ; NORMALIZATION EQUATION.
013F   23                          INX     H              ; ...
0140   E5                          PUSH    H              ; ...
0141   5E                          MOV     E,M            ; ...
0142   23                          INX     H              ; ...
0143   56                          MOV     D,M            ; ...
0144   23                          INX     H              ; ...
0145   F5                          PUSH    PSW            ; ...
0146   7E                          MOV     A,M            ; ...
0147   B7                          ORA     A              ; HAVE WE PROCESSED ALL OF 'DATTBL' YET ... ???
0148   CA      01D1                JZ      70$            ; BRANCH IF SO, ELSE CONTINUE WORKING ON TABLE.
014B   F5                          PUSH    PSW            ; ...
014C   D5                          PUSH    D              ; ...
014D   23                          INX     H              ; ...
014E   5E                          MOV     E,M            ; ...
014F   23                          INX     H              ; ...
0150   56                          MOV     D,M            ; ...
0151   E1                          POP     H              ; ...
0152   F1                          POP     PSW            ; ...
0153   4F                          MOV     C,A            ; ...
0154   F1                          POP     PSW            ; PRESENTLY, THE REGISTERS NOW CONTAIN: ...
0155   47                          MOV     B,A            ; <HL>=S(0),<DE>=S(1),<B>=V(0),<C>=V(1) ....
0156   79                          MOV     A,C            ; GET V(1), WITH BIT-8 = '1' IF A SPACE OR SLEW.
0157   17                          RAL                    ; IS THE S(1) CHARACTER A SPACE ?? ...
0158   D2      0169                JNC     66$            ; BRANCH IF NOT.
015B   EB                          XCHG                   ; LET THE CHAR. USE THE FULL <SP> DOMAIN IN
015C   29                          DAD     H              ; HIS S(1)/S(0) CALCULATION, BUT LATER YOU'LL
015D   EB                          XCHG                   ; SEE, HE DOESN'T ADD IT TO HIS MAPPED DOMAIN.
015E   3A      0000G               LDA     TSTATUS        ; IS UNDERLINING ON ?? ...
```

VELCAL: MICROBENCH 8080/8085 CROSS ASSEMBLER (V2)-26

```
 1 0161   E6   40                ANI   ^B01000000   ; BIT-7 = '1' IF UNDERLINNG ...
 2 0163   CA   0169              JZ    66$          ; NO, SO GIVE S(0) FULL SPACE DOMAIN
 3 0166   11   0000              LXI   D,^H0000     ; ELSE, GETS NONE OF <SP> DOMAIN FOR S(1)/S(0)
 4 0169                  66$:
 5 0169   EB                     XCHG               ; PUT S(1) IN TEMP. STORAGE FOR LATER USE ...
 6 016A   22   0000G             SHLD  S1           ; ...
 7 016D   EB                     XCHG               ; ...
 8 016E   78                     MOV   A,B          ; NOW ...
 9 016F   17                     RAL                ; IS V(0) A SPACE/SLEW TYPE VELOCITY ... ???
10 0170   D2   0174              JNC   67$          ; BRANCH IF NOT, ELSE ...
11 0173   29                     DAD   H            ; <SP> TAKES ITSELF PLUS 1/2 NEXT CHAR. TO MAX-
12 0174                  67$:
13 0174   22   0000G             SHLD  S0           ; IMIZE CARR. SPEED DURING NON-PRINTING.
14 0177   79                     MOV   A,C          ; IF <SP> FOLLOWS, LET CHAR. USE IT IN THE
15 0178   17                     RAL                ; S(1)/S(0) CALC., BUT NOT ADD IT TO HIS TOTAL
16 0179   DA   017D              JC    NOADD        ; DOMAIN USED UP IN THE PROFILE MAP.
17 017C   19                     DAD   D            ; ADD S(1) TO S(0) HERE.
18 017D                  NOADD:
19 017D   AF                     XRA   A            ; NOW, CALC THE EXACT DOMAIN FOR THE MAP.
20 017E   7C                     MOV   A,H          ; ...
21 017F   1F                     RAR                ; THIS WILL BE IS  (S(0) + S(1)) / 2 ...
22 0180   67                     MOV   H,A          ; ...
23 0181   7D                     MOV   A,L          ; ...
24 0182   1F                     RAR                ; ...
25 0183   6F                     MOV   L,A          ; ...
26 0184   EB                     XCHG               ; ...
27 0185   E1                     POP   H            ; GET THE POINTER INTO 'DATT8L' AND DOMAINS ...
28 0186   73                     MOV   M,E          ; STORE ACTUAL DOMAIN USED BY CHAR. OR <SP> ...
29 0187   23                     INX   H            ; ...
30 0188   72                     MOV   M,D          ; ...
31 0189   23                     INX   H            ; ...
32 018A   78                     MOV   A,B          ; IF THIS S(0) IS A SPACE, NO NEED TO NOR-
33 018B   17                     RAL                ; MALIZE SPEED, SINCE WE WANT MAX !!
34 018C   DA   013B              JC    65$          ; BRANCH IF THIS S(0) IS A <SP> CHARACTER.
35 018F   E5                     PUSH  H            ; ELSE, PERFOM VELOC. NORMALIZATION FUNCT. ...
36 0190   2A   0000G             LHLD  S0           ; ...
37 0193   E5                     PUSH  H            ; ...
38 0194   C1                     POP   B            ; ...
39 0195   2A   0000G             LHLD  S1           ; ...
40 0198   CD   0000G             CALL  XDIVIDE      ; <HL> = S(1)/S(0)
41 019B   23                     INX   H            ; <HL> = [ 1 + S(1)/S(0) ]
42 019C   3A   0000G             LDA   VELO         ; OBTAIN V(0) ...
43 019F   4F                     MOV   C,A          ; INSERT V(0) INTO THE MULTIPLIER REGISTER
44 01A0   06   00                MVI   B,^H00       ; ...
45 01A2   CD   0000G             CALL  XMULT        ; DO THE MULTIPLY OF <HL> * <BC> AND GET
46 01A5   AF                     XRA   A            ; <HL> = V(0) [ 1 + S(1)/S(0) ]
47 01A6   7C                     MOV   A,H          ; NOW, DIVIDE THE RESULT BY 1/2 ...
48 01A7   1F                     RAR                ; ...
49 01A8   67                     MOV   H,A          ; ...
50 01A9   7D                     MOV   A,L          ; ...
51 01AA   1F                     RAR                ; ...
52 01AB   6F                     MOV   L,A          ; <HL> = 1/2 ( V(0) [ 1 + S(1)/S(0) ] )
53 01AC   AF                     XRA   A            ; NOW, DETERMINE WHICH VELOCITY VALUE
54 01AD   BC                     CMP   H            ; TO USE. IF CALCULATED VALUE IS > THAN
55 01AE   C2   01C1              JNZ   69$          ; OR EQUAL TO V(0), THEN USE V(0). IF
56 01B1   3A   0000G             LDA   VELO         ; THE CALCULATED VALUE IS < V(0), THEN
57 01B4   95                     SUB   L            ; WE MUST USE THE CALCULATED VALUE BECAUSE
```

VELCAL: MICROBENCH 8080/8085 CROSS ASSEMBLER (V2)-26

```
01B5   FA   01C1          JM    69$          ; S(1) WAS SMALLER THEN S(0). ALSO, DETERMINE
01B8   7D                 MOV   A,L          ; AND MAKE SURE THE VALUE USED IS NOT LESS
01B9   B7                 ORA   A            ; THAN OR EQUAL TO ZERO ! ...
01BA   C2   01BE          JNZ   68$          ; ...
01BD   3C                 INR   A            ; ...
01BE                68$:
01BF   32   0000G         STA   VELO         ; HOLD THE RESULTANT VALUE TEMPORARILY.
01C1                69$:
01C1   E1                 POP   H            ; UPDATE THE 'DATTBL' POINTER AND CONTINUE ON
01C2   01   FFFD          LXI   B,-^H0003    ; WITH THE NORMALIZATION ...
01C5   09                 DAD   B            ; ...
01C6   3A   0000G         LDA   VELO         ; ...
01C9   77                 MOV   M,A          ; ...
01CA   01   0003          LXI   B,^H0003     ; ...
01CD   09                 DAD   B            ; ...
01CE   C3   013B          JMP   65$          ; ...
01D1                70$:
01D1   E1                 POP   H            ; CLEAN UP STACK, WE'RE DONE NORMALIZING ...
01D2   E1                 POP   H            ; ...
01D3                LOAD:
01D3   3E   0A            MVI   A,^B00001010 ; OKAY, NOW WE'RE GONNA LOAD THE BUFFER
01D5   30                 SIM                ; DATA ITSELF. CAN'T LET RST 6.5 HAPPEN !
01D6   2A   0000G         LHLD  LSTPTR       ; GET OUR ACTIVE POINTER INTO "VELBUF" AND SAVE
01D9   E5                 PUSH  H            ; FOR LATER WHEN WE SMOOTH THE PROFILE.
01DA   2A   0000G         LHLD  NCAPOS       ; NOW, MAP THE VELOC. BUFFER STARTNG FROM WHERE
01DD   EB                 XCHG               ; THE LAST DOMAIN LEFT OFF AND
01DE   2A   0000G         LHLD  LSTPOS       ; SET TO START OF THE 'OBJECT' DOMAIN.
01E1   CD   0000G         CALL  XTAKE2S      ; ...
01E4   19                 DAD   D            ; ...
01E5   7C                 MOV   A,H          ; ...
01E6   B5                 ORA   L            ; ...
01E7   CA   020F          JZ    100$         ; BRANCH IF COINCIDENT WITH 'OBJECT' DOM. START.
01EA   7C                 MOV   A,H          ; ALSO CHECK & ABORT IF 'OBJECT' DOMAIN START IS
01EB   17                 RAL                ; LEFT OF WHERE LAST DOMAIN LEFT OFF ...
01EC   DA   031B          JC    ABOVEL       ; ...
01EF   3A   0000G         LDA   DATTBL       ; IF 'OBJECT' DOMAIN IS FORWARD SLEW OR SPACE
01F2   17                 RAL                ; THEN MAP IN ONLY 'NCAPOS' - 'LSTPOS'.
01F3   D2   01FC          JNC   90$          ; BRANCH IF 'OBJECT' IS A CHARACTER ...
01F6   22   0001G         SHLD  DATTBL+1     ; ELSE ...
01F9   C3   020F          JMP   100$         ; GO AHEAD AND LOAD UP THE VELOCITY BUFFER.
01FC                90$:
01FC   D1                 POP   D            ; PAD THE VELOC. BUFFER WITH THE VELOCITY OF
01FD   D5                 PUSH  D            ; THE 'OBJECT', TO BRING US COINCIDENT WITH
01FE   01   FFF8          LXI   B,-^H0008    ; START OF THE 'OBJECT' DOMAIN CARR. POSITION.
0201   3A   0000G         LDA   DATTBL       ; ...
0204                95$:
0204   12                 STAX  D            ; ...
0205   09                 DAD   B            ; ...
0206   13                 INX   D            ; ...
0207   DA   0204          JC    95$          ; ...
020A   EB                 XCHG               ; UPDATE THE VELOCITY BUFFER POINTER TO
020B   2B                 DCX   H            ; INITIATE A NORMAL BUFFER LOAD ...
020C   22   0000G         SHLD  LSTPTR       ; ...
020F                100$:
020F   21   0000G         LXI   H,DATTBL     ; BEGIN UN-SMOOTHED PROFILE LOADING ...
0212                110$:
0212   01   FFF8          LXI   B,-^H0008    ; INIT THE VELOCITY INTERRUPT SPACER.
```

VELCAL; MICROBENCH 8080/8085 CROSS ASSEMBLER (V2)-26

```
0215   7E                          MOV     A,M            ; GET THE SPEED BYTE VALUE ...
0216   E6     7F                   ANI     ^B01111111     ; MASK OFF ANY POTENTIAL 'SLEW' FLAGS ...
0218   23                          INX     H              ; POINT TO DOMAIN VALUE FOR TABLE ENTRY ...
0219   5E                          MOV     E,M            ; AND GET IT ...
021A   23                          INX     H              ; ...
021B   56                          MOV     D,M            ; ...
021C   23                          INX     H              ; END UP POINTING TO NEXT ENTRY'S SPEED BYTE.
021D   E5                          PUSH    H              ; SAVE POINTER INTO "DATTBL".
021E   2A     0000G                LHLD    LSTPTR         ; GET PRESENT POINTER INTO "VELBUF".
0221                       120$:
0221   77                          MOV     M,A            ; LOAD UP BUFFER FOR LENGTH OF THE DOMAIN ...
0222   23                          INX     H              ; ...
0223   EB                          XCHG                   ; ...
0224   09                          DAD     B              ; ...
0225   EB                          XCHG                   ; ...
0226   DA     0221                 JC      120$           ; LOOP TILL DOMAIN ALL LOADED UP.
0229   2B                          DCX     H              ; RESET BUFFER POINTER FOR NEXT LOADING LOOP.
022A   22     0000G                SHLD    LSTPTR         ; SAVE FOR THE NEXT TABLE ENTRY.
022D   EB                          XCHG                   ; HOLD VELOCITY BUFFE POINTER IN <DE>.
022E   E1                          POP     H              ; RESTORE POINTER INTO "DATTBL".
022F   47                          MOV     B,A            ; HOLD PRESENT VELOCITY VALUE.
0230   7E                          MOV     A,M            ; GET NEXT ENTRY'S VELOCITY.
0231   E6     7F                   ANI     ^B01111111     ; IF VELOCITY OF NEXT ENTRY IS ZERO, WE HAVE
0233   CA     023F                 JZ      SMOOTH         ; END OF 'DATTBL', BEGIN SMOOTHING PROCEEDURE.
0236   B8                          CMP     B              ; IS PRESENT VELOCITY LESS THAN THE NEXT ... ???
0237   D2     0212                 JNC     110$           ; GOOD, WE'LL USE IT AS IS, ELSE ...
023A   1B                          DCX     D              ; USE THE NEXT VELOCITY (LESSER) FOR THE
023B   12                          STAX    D              ; DOMAIN TRANSITION VELOCITY.
023C   C3     0212                 JMP     110$           ; THEN, GO LOAD UP THE NEXT TABLE ENTRY.
023F                       SMOOTH:
023F   2A     0000G                LHLD    LSTPTR         ; GET POINTER INTO THE VELOCITY BUFFER AND
0242   23                          INX     H              ; POINT IT BEYOND THE UNSMOOTHED PROFILE, THEN
0243   06     0D                   MVI     B,^D13         ; PAD THE END WITH 1.0"/SEC VALUES FOR
0245   3E     02                   MVI     A,^D02         ; GOOD MEASURE ... !!!
0247                       123$:
0247   77                          MOV     M,A            ; ...
0248   23                          INX     H              ; ...
0249   05                          DCR     B              ; ...
024A   C2     0247                 JNZ     123$           ; ...
024D   E1                          POP     H              ; RESTORE THE ORIGINAL "LSTPTR" VALUE.
024E   22     0000G                SHLD    LSTPTR         ; AND SAVE FOR USE DURING SMOOTHING.
0251   3A     0000G                LDA     TYPCAL         ; NOW, LET'S DETERMINE OUR FIRST REFERENCE
0254   B7                          ORA     A              ; VELOCITY ...
0255   2B                          DCX     H              ; CHECK IF THE CARRIAGE WAS MOVING ...
0256   7E                          MOV     A,M            ; ...
0257   C2     025F                 JNZ     125$           ; AND IF WE WERE, BRANCH AND KEEP "VELREF".
025A   3A     0000G                LDA     DATTBL         ; STOPPED, SO USE FIRST MAX SPEED BYTE IN
025D   E6     0F                   ANI     ^B00001111     ; 'DATTBL' AS AN INITIAL VELOCITY REFERENCE.
025F                       125$:
025F   2A     0001G                LHLD    DATTBL+1       ; LOAD UP THE 'OBJECT' DOMAIN VALUE.
0262   F5                          PUSH    PSW            ; SAVE THE SPEED WHILE <A> GETS USED.
0263   3A     0000G                LDA     DATTBL         ; IF THE 'OBJECT' DOMAIN IS 'SPACE' OR 'SLEW'
0266   17                          RAL                    ; THEN THE DOMAIN OF IT IS ALREADY BUILT INTO
0267   D2     026D                 JNC     126$           ; 'NCAPOS' ... BRANCH IF REGUALR CHARACTER ...
026A   2A     0000G                LHLD    NHDVAL         ; ELSE USE 'NHDVAL' INCASE OF SPACE UNDERLINES.
026D                       126$:
026D   F1                          POP     PSW            ; RESTORE THE SPEED BYTE.
```

VELCAL: MICROBENCH 8080/8085 CROSS ASSEMBLER (V2)-26

```
026E  EB                    XCHG
026F  2A   0000G            LHLD    NCAPOS      ; ...
0272  19                    DAD     D           ; ...
0273  EB                    XCHG                ; ...
0274  2A   0000G            LHLD    LSTPOS      ; LSTPOS(n+1) = NCAPOS + (SCALED DOMAIN)
0277  CD   0000G            CALL    XTAKE2S     ; COUNT=[NCAPOS+(SCALED DOMAIN)-LSTPOS]/8
027A  19                    DAD     D           ; ...
027B  EB                    XCHG                ; ...
027C  22   0000G            SHLD    LSTPOS      ; ...
027F  EB                    XCHG                ; ...
0280  01   0008             LXI     B,^H0008    ; ...
0283  CD   0000G            CALL    XDIVIDE     ; ...
0286  4F                    MOV     C,A         ; ...
0287  E5                    PUSH    H           ; SAVE THE # OF ENTRIES FOR 'OBJECT' DOMAIN.
0288  2B                    DCX     H           ; MAKE SURE THAT IF THE NUMBER OF
0289  7C                    MOV     A,H         ; ENTRIES IS ZERO, THAT WE ABORT ...
028A  17                    RAL                 ; ...
028B  DA   031B             JC      ABOVEL      ; ABORT IF ZERO ENTRIES ... !!!
028E  2A   0000G            LHLD    LSTPTR      ; GET POINTER INTO THE VELOCITY BUFFER.
0291                LOOP1:
0291  06   03               MVI     B,^D11      ; INIT THE CHARACTER DISPLACEMENT TRACKER.
0293  16   01               MVI     D,^H01      ; INIT DELTA-V TO 0.5"/S.
0295  E5                    PUSH    H           ; SAVE THE "VELBUF" POINTER ON THE STACK.
0296                LOOP2:
0296  7E                    MOV     A,M         ; GET THE MAX. VEL. VALUE FOR THIS INTERRUPT.
0297  91                    SUB     C           ; PERFORM V(n) - V(ref) = DIFFERNECE.
0298  FA   02A6             JM      TABLOK      ; BRANCH IF DIFFERNECE IS NEGATIVE OR ...
029B  CA   02A6             JZ      TABLOK      ; EQUAL TO ZERO FOR A TABLE LOOK-UP.
029E                KEPLOK:
029E  05                    DCR     B           ; THAT SPEED WAS FASTER THAN V(ref).
029F  23                    INX     H           ; POINT TO NEXT SPEED VALUE IN LINE.
02A0  F2   0296             JP      LOOP2       ; CONTINUE FOR 12 INTERRUPT LOOK AHEAD.
02A3  C3   02D5             JMP     NEWVEL      ; AND GO DETERMINE NEW VELOCTIY.
02A6                TABLOK:
02A6  E5                    PUSH    H           ; SAVE POINTER INTO "VELBUF".
02A7  D5                    PUSH    D           ; SAVE PRESENT DELTA-V VALUE.
02A8  2F                    CMA                 ; TAKE 2's ...
02A9  3C                    INR     A           ; ...
02AA  11   000C             LXI     D,^D12      ; "VELTBL: OFFSET FOR EACH UNIT IN <A>.
02AD  2A   0000G            LHLD    XVELTBL     ; BASE ADDRESS INTO "VELTBL".
0280  B7                    ORA     A           ; TRIP THE ZERO FLAG ...
02B1                BASLOP:
02B1  CA   02B9             JZ      CONT        ; DO WE HAVE PROPER DELTA-V INDEX ADDR ... ?
02B4  19                    DAD     D           ; NO ... INDEX IN 12 MORE BYTES.
02B5  3D                    DCR     A           ; ...
02B6  C3   02B1             JMP     BASLOP      ; ...
02B9                CONT:
02B9  3E   0B               MVI     A,^D11      ; SWITCH <B> AROUND SO WE CAN USE IT
02BB  90                    SUB     B           ; IN OFFSET DETEMINATION.
02BC  5F                    MOV     E,A         ; SET UP OFFSET ...
02BD  16   00               MVI     D,^H00      ; ...
02BF  19                    DAD     D           ; WE HAVE POINTER INTO "VELTBL".
02C0  7E                    MOV     A,M         ; GET THE LOOK-UP DELTA-V VALUE ...
02C1  D1                    POP     D           ; RESTORE ...
02C2  E1                    POP     H           ; RESTORE ...
02C3  B7                    ORA     A           ; SET THE STATUS FLAGS BASED ON DELTA-V.
02C4  F2   02CB             JP      UP          ; BRANCH IF NOT -0.5"/S.
```

VELCAL: MICROBENCH 8080/8085 CROSS ASSEMBLER (V2)-26

```
02C7   57                          MOV   D,A          ; OKAY ... WE MUST SLOW DOWN CARRIAGE.
02C8   C3     02D5                 JMP   NEWVEL       ; AND NO POINT OIN SCANNING FUTHER EITHER.
02CB                       UP:
02CB   CA     02D1                 JZ    STAY         ; BRANCH IF SPEED REMAINS CONSTANT.
02CE   C3     029E                 JMP   KEPLOK       ; KEEP DELTA-V = +0.5"/S.
02D1                       STAY:
02D1   57                          MOV   D,A          ; DELTA-V = 0.0"/S.
02D2   C3     029E                 JMP   KEPLOK       ; KEEP GOING INCASE WE MUST SLOW DOWN ELSEWHERE.
02D5                       NEWVEL:
02D5   79                          MOV   A,C          ; GET THE PRESENT VELOCITY ... V(0).
02D6   82                          ADD   D            ; DETERMINE THE NEW VELOCITY.
02D7   FE     01                   CPI   ^H01         ; ARE WE LESS THAN 0.5"/S ... ?
02D9   F2     02E1                 JP    NOTZER       ; BRANCH IF WE ARE NOT.
02DC   3E     01                   MVI   A,^H01       ; MAKE VELOCITY 0.5"/S ... NOT ZERO !!
02DE   C3     02E8                 JMP   HAVE         ; AND CONTINUE.
02E1                       NOTZER:
02E1   FE     0D                   CPI   ^D13         ; ARE WE GREATER THAN 6.0"/S ... ?
02E3   FA     02E8                 JM    HAVE         ; BRANCH IF WE ARE NOT.
02E6   3E     0C                   MVI   A,^D12       ; ELSE, FORCE NEW VELOCITY TO 6.0"/S.
02E8                       HAVE:
02E8   E1                          POP   H            ; RESTORE THE "VELBUF" POINTER.
02E9   77                          MOV   M,A          ; STORE VELOCITY IN "VELBUF" FOR "INTVEL".
02EA   4F                          MOV   C,A          ; INIT NEW V(ref) FOR NEXT LOOP.
02EB   23                          INX   H            ; UPDATE "VELBUF" POINTER.
02EC   D1                          POP   D            ; CHECK FOR END OF FUNCTION ...
02ED   1B                          DCX   D            ; ...
02EE   D5                          PUSH  D            ; ...
02EF   7A                          MOV   A,D          ; ...
02F0   B3                          ORA   E            ; ARE WE DONE ... ?
02F1   C2     0291                 JNZ   LOOP1        ; BRANCH IF NOT DONE.
02F4   D1                          POP   D            ; DONE ... CLEAN UP THE STACK.
02F5   22     0000G                SHLD  LSTPTR       ; STORE "VELBUF" POINTER FOR US NEXT TIME.
02F8   06     0D                   MVI   B,^D13       ; INSURE THAT BUFFER HAS SLOW SPEEDS FOL-
02FA   3E     02                   MVI   A,^D02       ; LOWWING OUR ENTRIES ...
02FC                       PAD:
02FC   77                          MOV   M,A          ; ...
02FD   23                          INX   H            ; ...
02FE   05                          DCR   B            ; ...
02FF   C2     02FC                 JNZ   PAD          ; LOOP FOR 12 0.5"/S ENTRIES.
0302                       127$:
0302   AF                          XRA   A            ; RESTORE "BCKFLG" ...
0303   32     0000G                STA   BCKFLG       ; ...
0306   F1                          POP   PSW          ; RESTORE "TCHRCNT" ...
0307   32     0000G                STA   TCHRCNT      ; ...
030A   E1                          POP   H            ; RESTORE "TCHRPTR" ...
030B   22     0000G                SHLD  TCHRPTR      ; ...
030E   E1                          POP   H            ; RESTORE THE INPUT DATA BUFFER POINTER ...
030F   22     0000G                SHLD  IBFPTR       ; ...
0312   3A     0000G                LDA   SLWFLG       ; IF 'SLWFLG' ON, THEN WE ARE REV. SLEWING ...
0315   B7                          ORA   A            ; AND THUS WE DON'T WANT RST 6.5 ON ... !!!
0316   C0                          RNZ                ; SO WE'D JUST RETURN.
0317   3E     08                   MVI   A,^B00001000 ; NOW WE CAN RE-ENABLE THE RST 6.5 INTERRUPT ...
0319   30                          SIM                ; ...
031A   C9                          RET                ; AND ... RETURN THE CALLER.
031B                       ABOVEL:
031B   E1                          POP   H            ; RESTORE THE STACK AND OTHER VAIABLES BEFORE
031C   C3     0302                 JMP   127$         ; ABORTING AND LEAVING.
```

```
VELCAL; MICROBENCH 8080/8085 CROSS ASSEMBLER (V2)-26

      1
      2                                   DSABL   LSB
      3
      4                                   END
VELCAL; MICROBENCH 8080/8085 CROSS ASSEMBLER (V2)-26
SYMBOL TABLE

A        %0007          ABOVEL   031B          ABSHGH= ****          ABSLOW= ****          B       %0000
BASLOP   0281           BCKFLG= ****           C       %0001         CONT    0269          D       %0002
DATTBL= ****            E       %0003          H       %0004         HAVE    02E8          IBFPTR= ****
KEPLOK   029E           L       %0005          LCAPOS= ****          LHDVAL= ****          LOAD    01D3
LOOP1    0291           LOOP2    0296          LSTPOS= ****          LSTPTR= ****          M       %0006
NCAPOS= ****            NEWVEL   02D5          NHDVAL= ****          NOADD   017D          NORMAL   012D
NOTZER   02E1           PAD      02FC          PSW     %0006         SCALSD  0138          SLWFLG= ****
SMOOTH   023F           SP      %0006          STAY     02D1         SO    = ****          S1    = ****
TABLOK   02A6           TCHRCN= ****           TCHRPT= ****          TRNFLG= ****          TSTATU= ****
TYPCAL= ****            UP       02C8          VELBUF= ****          VELCAL  0000          VELPTR= ****
VELREF= ****            VELO   = ****          XDIVID= ****          XDOMCA= ****          XMULT = ****
XSPACE= ****            XSPDTB= ****           XTAKE2= ****          XVELTB= ****          XYREAL= ****

@ ABS@  031F    00

MODULE: VELCAL
ERRORS DETECTED: 0

FREE CORE: 4968. WORDS
,VELCAL=VELCAL/C/E:GBL:LC/N:TOC/L:SYM

VELCAL; MICROBENCH 8080/8085 CROSS ASSEMBLER (V2)-26
CROSS REFERENCE TABLE (CREF V01-05 )

ABOVEL    2-5      2-26     6-35     8-18     9-55#
ABSHGH    1-22
ABSLOW    1-29
BASLOP    8-42#    8-46
BCKFLG    1-53*    9-42*
CONT      8-43     8-47#
DATTBL    1-54     2-27*    2-29*    2-31     4-5      4-26     6-36     6-39*    6-45     6-55     7-47     7-50     7-52
HAVE      9-15     9-18     9-20#
IBFPTR    1-44     1-47*    2-10     2-12*    2-34     2-45*    9-48*
KEPLOK    8-29#    9-5      9-8
LCAPOS    2-13
LHDVAL    2-15
LOAD      6-20#
LOOP1     8-20#    9-30
LOOP2     8-24#    8-32
LSTPOS    1-28*    1-30*    6-27     8-5      8-9*
LSTPTR    1-33*    6-23     6-53*    7-9      7-18*    7-31     7-41*    8-19     9-32*
NCAPOS    2-19     6-25     8-2
NEWVEL    8-33     9-2      9-9#
NHDVAL    2-22     7-55
NOADD     5-16     5-18#
NORMAL    2-38     4-10     4-14#
NOTZER    9-13     9-16#
PAD       9-35#    9-39
SO        5-13*    5-36
S1        5-6*     5-39
```

```
SCALSD    4-25#
SLWFLG    1-57      9-49
SMOOTH    7-24      7-30#
STAY      9-4       9-6#
TABLOK    8-27      8-28      8-34#
TCHRCN    1-50      9-44*
TCHRPT    1-48      3-11      9-46*
TRNFLG    2-41
TSTATU    2-7       2-51      3-13      3-35      3-43      4-57
TYPCAL    1-19*     2-3       7-42
UP        8-57      9-3#
VELO      4-29*     5-42      5-56      6-7*      6-12
VELBUF    1-31
VELCAL    1-17#
VELPTR    1-32*
VELREF    1-18
XDIVID    5-40      8-12
XDOMCA    3-10
XMULT     5-45
XSPACE    2-47
XSPDTB    3-28
XTAKE2    2-17      4-6       6-28      8-6
XVELTB    8-40
XYREAL    3-30

VELCAL: MICROBENCH 8080/8085 CROSS ASSEMBLER (V2)-26
CROSS REFERENCE TABLE (CREF V01-05 )

$$INIT    0-0#
```

What is claimed is:

1. In a calligraphic printing apparatus having a moving carriage carrying a movable stylus mechanism, a carriage control element, and means responsive to the carriage control element for moving said carriage along a printing path, said printing path being divisible into a plurality of distance-velocity increments, wherein as said carriage moves along said printing path a plurality of symbols are written by said movable stylus, the improvement wherein said carriage control element comprises means for determining, for each distance-velocity increment along said printing path, a maximum carriage velocity, said maximum carriage velocity being dependent on the complexity of said symbol, and means responsive to said maximum carriage velocities for determining, for each distance-velocity increment along said printing path, an optimum change in carriage velocity, whereby said carriage can traverse said printing path at a velocity which varies as a function of the complexities of the particular characters being written by said stylus thereby to provide adequate time over which each character can be written from said moving carriage.

2. In a calligraphic printing apparatus having a movable carriage carrying a movable stylus mechanism, a carriage control element, and means responsive to the carriage control element for moving said carriage along a printing path, said printing path being divisible into a plurality of distance-velocity increments, wherein as said carriage moves along said printing path a plurality of symbols are written by said movable stylus, the improvement wherein said carriage control element comprises first means for storing printing path time/velocity data for each printing symbol, said printing path time/velocity being dependent on the complexity of said symbol, second means for storing at least a selected minimum number of next symbols to be printed in said path, means responsive to said first and second storage means for associating with each said increment a corresponding maximum carriage velocity, and means responsive, at each increment to a minimum number of next increments and said maximum carriage velocities associated therewith for controlling carriage velocity changes along said printing path, whereby said carriage can traverse said printing path at a velocity which varies as a function of the complexities of the particular characters being written by said stylus thereby to provide adequate time over which each character can be written from said moving carriage.

3. The apparatus of claim 2 wherein each said symbol occupies an equal spatial symbol duration along said printing path, and said distance-velocity increment is an integer divisor of said symbol spatial duration along said printing path.

4. The apparatus of claim 2 wherein said carriage further comprises a carriage body, a printing element supported by said printing mechanism, and means for controlling the velocity of the printing element in response to a velocity input control signal, said printing element velocity control means moving said printing element relative to the moving carriage body at least in the direction of the movement of the carriage, signal means responsive to the position of said carriage along said printing path, and means for modifying said velocity input control signal to said printing element in response to the position of said carriage indicated by said signal means.

5. In a calligraphic printing apparatus having a moving carriage for carrying a calligraphic stylus mechanism, a carriage control element, and means responsive to the carriage control element for moving said carriage along a printing path, said printing path being divisible into a plurality of distance-velocity increments, wherein as said carriage moves along said path said stylus mechanism writes a plurality of symbols, the improvement comprising a carriage position responsive means for providing an output signal representing the position of said carriage along said printing path, a first storage means for storing, for each symbol to be written by said apparatus, a time/velocity data representing the writing time for said symbol at a standard writing size, a second storage means for storing at least a selected minimum number of next sequential symbols to be printed in said path, said second storage means being continuously updated to provide at least a selected minimum number of next symbols to be printed in said printing line path, a third storage means for storing carriage velocity data representing the maximum carriage velocity at distance velocity increments along said printing path, and a fourth storage means for storing data representing an optimum carriage velocity profile along said printing path, said carriage control element comprising means responsive to each symbol to be printed, for determining the maximum carriage velocity at each distance-velocity increment along said printing path and storing said determined maximum velocities in said third storage element, and means responsive to said maximum carriage velocity data in said third storage element for determining an optimum carriage velocity profile along said printing path, said last means comprising means for looking ahead, at each distance-velocity increment, for a minimum number of next distance-velocity increments, in said third storage means and, in response to said next maximum carriage velocities determining a carriage velocity change from the present distance-velocity increment to the next distance-velocity increment whereby said carriage can traverse said printing path at a velocity which varies as a function of the complexities of the particular characters being written by said stylus thereby to provide a adequate time over which each character can be written from said moving carriage.

6. The printing apparatus of claims 1, 2 or 5 wherein said carriage control element further comprises a storage means for storing a look-up chart for determining, in response to a present carriage velocity and a maximum future carriage velocity for one of said next increments, the allowable carriage velocity change for the next velocity distance increment.

7. In a calligraphic printing apparatus having a moving carriage carrying a printing mechanism, a carriage control element, and means responsive to the carriage control element for moving the carriage along a printing path, said printing path being divisible into a plurality of sequential distance-velocity increments, wherein as the carriage moves along the printing path a plurality of symbols are written, a carriage velocity control method comprising the steps of determining, for each increment, and in response to the symbols at least in part written in said increment, a maximum carriage velocity, said maximum carriage velocity being dependent on the complexity of said symbol, and determining, for each increment along said printing path, an optimum velocity change for said carriage from said increment to a next increment, whereby said carriage can traverse said printing path at a velocity which varies as a function of the complexities of the particular characters being written by said stylus thereby to provide a adequate time over which each character can be written from said moving carriage.

8. The method of claim 7 further comprising the steps of storing symbols for an entire printing line, determining said maximum carriage speed for the entire printing line, determining the optimum velocity changes for the entire line, and thereafter writing said entire line of symbols.

9. The method of claim 7 further comprising the steps of storing incoming symbols to be written, determining maximum carriage speeds for increments corresponding to at least a part of said stored symbols, determining the optimum velocity changes for at least a portion of the increments for which maximum carriage velocities have been determined, and writing those symbols corresponding to increments for which velocity changes have been determined, said storing, first and second determining, and writing steps being performed on a demand basis.

10. The method of claim 8 wherein said second determining step for each increment comprises the steps of employing a look-ahead table having entries relating the difference between the actual carriage velocity in one increment and the maximum velocity in a later occurring increment to the distance between increments, for determining the carriage change value corresponding to the later occurring increment, and repeatedly determining for each of a predetermined number of next occurring increments a velocity change value, and determining said velocity change command for said one increment from said velocity change values.

11. The method of claim 9 wherein said second determining step for each increment comprises the steps of employing a look-ahead table having entries relating the difference between the actual carriage velocity in one increment and the maximum velocity in a later occurring increment to the distance between increments, for determining the carriage change value corresponding to the later occurring increment, and repeatedly determining for each of a predetermined number of next occurring increments a velocity change value, and determining said velocity change command for said one increment from said velocity change values.

12. The method of claims 10 or 11 comprising the steps of decreasing carriage velocity whenever a velocity change value indicates a reduction in carriage velocity, and terminating said repeatedly determining step whenever a velocity change decrease is determined.

13. The method of claims 10 or 11 further comprising the steps of mounting a stylus writing element to said printing mechanism, and compensating a drive to said stylus element for taking account of a continuously changing, carriage position.

14. The method of claim 7 further wherein said first determining step comprises the step of selecting for each distance-velocity increment which is associated with the writing of two adjacent symbols, the smaller of the maximum velocities associated with said adjacent symbols.

15. The method of claim 7 further wherein said first determining step comprises the step of reducing the maximum velocity associated with a distance-velocity increment for reducing carriage travel whenever carriage overtravel from one to another of two adjacent symbols would otherwise occur.

* * * * *